US010185281B2

(12) United States Patent
Shimizu et al.

(10) Patent No.: US 10,185,281 B2
(45) Date of Patent: Jan. 22, 2019

(54) IMAGE FORMING APPARATUS PROVIDED WITH A PHOTOSENSITIVE MEMBER HAVING A PHOTOSENSITIVE LAYER AND A SURFACE PROTECTION LAYER WHICH IS FORMED ON THE SURFACE OF THE PHOTOSENSITIVE LAYER AND WHICH HAS A HARDNESS HIGHER THAN THAT OF THE PHOTOSENSITIVE LAYER

(71) Applicant: KYOCERA Document Solutions Inc., Osaka (JP)

(72) Inventors: Tamotsu Shimizu, Osaka (JP); Yoshihiro Yamagishi, Osaka (JP); Akifumi Yamaguchi, Osaka (JP); Koji Uno, Osaka (JP); Kenichi Kasama, Osaka (JP); Yuta Kitabayashi, Osaka (JP); Nobuyuki Hayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/953,039

(22) Filed: Apr. 13, 2018

(65) Prior Publication Data

US 2018/0335748 A1 Nov. 22, 2018

(30) Foreign Application Priority Data

May 19, 2017 (JP) ..... 2017-099666

(51) Int. Cl.
*G03G 15/00* (2006.01)
*G03G 21/00* (2006.01)
(Continued)

(52) U.S. Cl.
CPC ..... *G03G 21/0058* (2013.01); *G03G 5/005* (2013.01); *G03G 5/14704* (2013.01);
(Continued)

(58) Field of Classification Search
CPC ..... G03G 21/0058; G03G 21/0011; G03G 21/0064; G03G 5/005; G03G 5/14704;
(Continued)

(56) References Cited

U.S. PATENT DOCUMENTS 9,726,994 B1 * 8/2017 Eri ..... G03G 15/0865
2016/0320720 A1 * 11/2016 Murata ..... G03G 15/5033
2016/0349694 A1 * 12/2016 Shoji ..... G03G 15/55

FOREIGN PATENT DOCUMENTS

JP 2005-321558 A * 11/2005
JP 4623922 B2 11/2010
(Continued)

*Primary Examiner* — Sophia S Chen
(74) *Attorney, Agent, or Firm* — Stein IP, LLC

(57) ABSTRACT

An image forming apparatus has a photosensitive member, a charging member, an exposing device, a developing device, a transfer member, a polishing member, a driving device, a voltage applying device, a torque detector, and a control portion. The photosensitive member has a photosensitive layer and a surface protection layer formed on the surface of the photosensitive layer. The polishing member has an elastic layer on its circumferential surface, and rotates with a linear velocity difference from that of the photosensitive member. The torque detector detects the torque of the driving device. The control portion estimates an attachment condition of discharge products to the surface of the photosensitive member based on the torque of the driving device detected by the torque detector. When the torque is equal to or higher than a predetermined value, the control portion performs an image degradation suppression process.

18 Claims, 12 Drawing Sheets

(51) Int. Cl.
*G03G 5/147* (2006.01)
*G03G 5/00* (2006.01)
*G03G 15/08* (2006.01)

(52) U.S. Cl.
CPC ..... *G03G 15/0865* (2013.01); *G03G 15/5008* (2013.01); *G03G 15/5037* (2013.01); *G03G 15/55* (2013.01); *G03G 21/0011* (2013.01); *G03G 21/0064* (2013.01); *G03G 2221/0089* (2013.01)

(58) Field of Classification Search
CPC ..... G03G 15/0865; G03G 15/5008; G03G 15/5037; G03G 15/55; G03G 2221/0089
See application file for complete search history.

(56) References Cited

FOREIGN PATENT DOCUMENTS

| | | | | |
|---|---|---|---|---|
| JP | 2011-158790 | A | | 8/2011 |
| JP | 2012-226043 | A | * | 11/2012 |

* cited by examiner

IMAGE FORMING APPARATUS PROVIDED WITH A PHOTOSENSITIVE MEMBER HAVING A PHOTOSENSITIVE LAYER AND A SURFACE PROTECTION LAYER WHICH IS FORMED ON THE SURFACE OF THE PHOTOSENSITIVE LAYER AND WHICH HAS A HARDNESS HIGHER THAN THAT OF THE PHOTOSENSITIVE LAYER

INCORPORATION BY REFERENCE

This application is based upon and claims the benefit of priority from the corresponding Japanese Patent Application No. 2017-099666 filed on May 19, 2017, the entire contents of which are incorporated herein by reference.

BACKGROUND

The present disclosure relates to image forming apparatuses that form an image on a recording medium such as paper. More particularly, the present disclosure relates to a method for estimating the attachment condition of discharge products to the surface of a photosensitive member on which a photosensitive layer and a surface protection layer are formed, and thereby preventing image defects such as image deletion.

In image forming apparatuses such as printers, copiers, facsimile machines, and multifunctional peripherals having their functions integrated together, as a photosensitive drum, which is an example of an image carrying member, an amorphous silicon photosensitive member having formed on its surface an amorphous silicon layer, or an organic photosensitive member having formed on its surface an organic photosensitive layer, is widely used. With a view to improving the stability of image quality over a long period of time and thereby achieving a prolonged life of the photosensitive drum, a photosensitive member that has formed on it a surface protection layer which protects the surface of the photosensitive layer is used. For example, an amorphous silicon photosensitive member has formed on it a surface protection layer comprising amorphous silicon carbide or amorphous carbon which has a higher hardness and which excels in wear resistance and print resistance.

If the above-described surface protection layer is oxidized in the process of the electrostatic charging of the photosensitive layer, or is soiled with active substances such as ozone, NOx, and SOx and their reaction products, that is, so-called discharge products, in a high-humidity environment, the oxidized part or the discharge products adsorb moisture, forming a low-resistance layer. As a result, the electric charge of a latent image may inconveniently flow in the planar direction, causing the image to blur, or to ooze as if rubbed against, that is, so-called image deletion is inconveniently made more likely to occur.

As a solution, various methods have been proposed for removing an oxidized part of the photosensitive layer and discharge products attached to the photosensitive layer and thereby preventing image deletion. For example, according to one known method, the surface condition of the photosensitive member is detected by use of the driving torque of the photosensitive member, and polishing conditions such as the pressing force and the rotation speed of the rubbing member are changed based on the result of detection. According to another known method, the driving torque of the cleaning brush is measured, and the amount of toner left unused on the photosensitive member is controlled based on the result of detection.

SUMMARY

According to one aspect of the present disclosure, an image forming apparatus includes a photosensitive member, a charging member, an exposing device, a developing device, a transfer member, a polishing member, a driving device, a voltage applying device, a torque detector, and a control portion. The photosensitive member has a photosensitive layer and a surface protection layer which is formed on the surface of the photosensitive layer and which has a hardness higher than that of the photosensitive layer. The charging member electrostatically charges the photosensitive member. The exposing device forms an electrostatic latent image on the surface of the photosensitive member having been electrostatically charged by the charging member. The developing device has a toner carrying member which carries on it toner containing polishing particles, and feeds toner from the toner carrying member to the photosensitive member and thereby develops the electrostatic latent image into a toner image. The transfer member transfers the toner image formed on the photosensitive member to a recording medium. The polishing member has an elastic layer on its circumferential surface in contact with the photosensitive member, and polishes the surface of the photosensitive member while rotating in contact with the photosensitive member with a linear velocity difference from that of the photosensitive member. The driving device drives the polishing member to rotate. The voltage applying device applies voltages to the charging member, the toner carrying member, and the transfer member respectively. The torque detector detects the torque of the driving device observed when the polishing member is driven to rotate. The control portion estimates the attachment condition of discharge products to the surface of the photosensitive member based on the torque of the driving device detected by the torque detector. When the torque of the driving device detected by the torque detector is equal to or higher than a predetermined value, the control portion performs an image degradation suppression process to prevent degradation of image quality resulting from the discharge products.

Further features and advantages of the present disclosure will become apparent from the description of embodiments given below.

DETAILED DESCRIPTION

Figure 1:
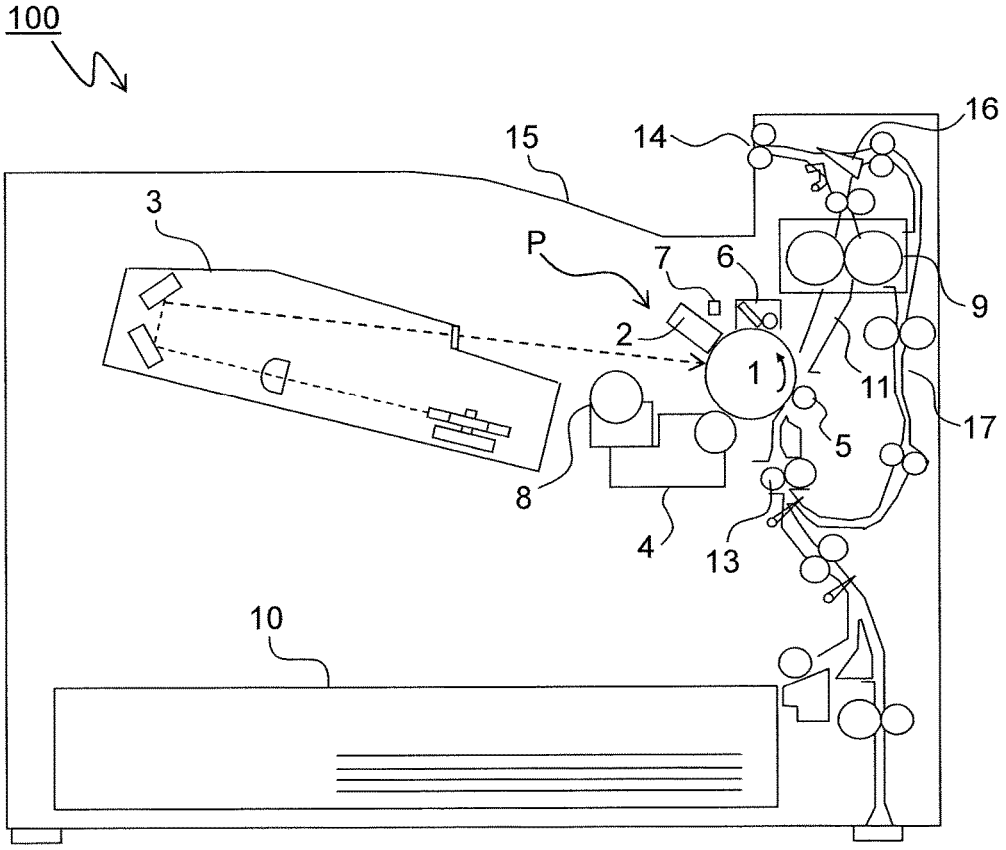
FIG. 1 is a side sectional view showing an outline of a construction of an image forming apparatus according to a first embodiment of the present disclosure.

Hereinafter, embodiments of the present disclosure will be described with reference to the accompanying drawings. FIG. 1 is a schematic diagram showing an overall construction of an image forming apparatus 100 according to a first embodiment of the present disclosure. In the main body of the image forming apparatus (for example, a monochrome printer) 100, there is arranged an image forming portion P which forms a monochrome image through the processes of electrostatic charging, exposure to light, image development, and image transfer.

In the image forming portion P, there are arranged, along the rotation direction of a photosensitive drum 1 (the counter-clockwise direction in FIG. 1), a charging device 2, an exposing device 3, a developing device 4, a transfer roller 5, a cleaning device 6, and a destaticizer 7. In the image forming portion P, an image forming process is performed with respect to the photosensitive drum 1 while it is rotated in the counter-clockwise direction in FIG. 1.

A printing operation proceeds as follows. Image data transmitted from a host device such as a personal computer is converted into an image signal. On the other hand, in the image forming portion P, the photosensitive drum 1 that rotates in the counter-clockwise direction in FIG. 1 is electrostatically charged uniformly by the charging device 2, and is then, based on the image signal, irradiated with laser light by the exposing device 3 so that an electrostatic latent image based on the image data is formed on the surface of the photosensitive drum 1. Then, the toner carried on a developing roller 4*a* (see FIG. 2) of the developing device 4 is attached to the electrostatic latent image, and thereby a toner image is formed. Toner is fed to the developing device 4 from a toner container 8.

Toward the image forming portion P where the toner image has been formed as described above, with predetermined timing, a sheet is conveyed from a sheet storage 10 via a sheet conveyance passage 11 and a registration roller pair 13, and at a nip between the photosensitive drum 1 and the transfer roller 5, the toner image on the surface of the photosensitive drum 1 is transferred to the sheet. Then, the sheet having the toner image transferred to it is separated from the photosensitive drum 1, and is conveyed to a fixing portion 9, where the toner image is heated and pressed so as to be thereby fixed to the sheet. The sheet having passed through the fixing portion 9 is distributed among different conveyance directions by a branching guide 16 arranged in a branching portion in the sheet conveyance passage 11, and is discharged as it is (or after being conveyed to a reverse conveyance passage 17 and having images formed on both sides of it) via the discharge roller pair 14 onto a sheet discharge portion 15.

Figure 2:
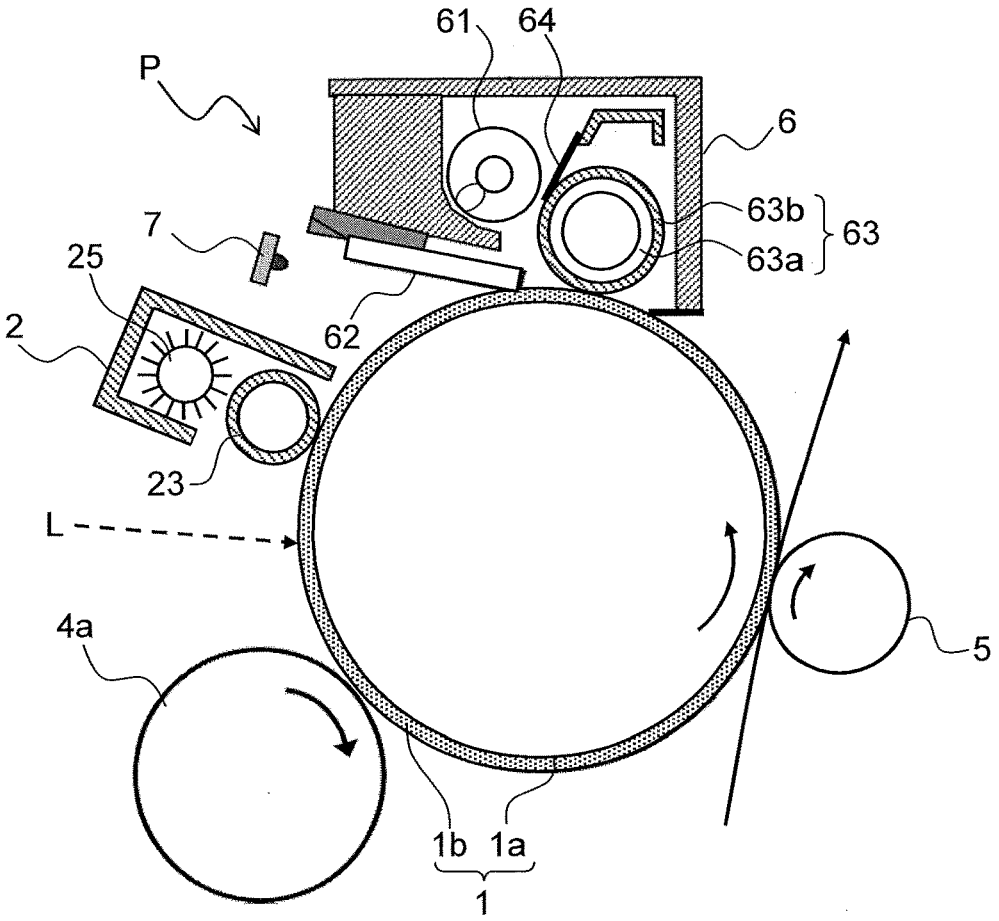
FIG. 2 is a partly enlarged view around the image forming portion in FIG. 1.

FIG. 2 is a partly enlarged view around the image forming portion P in FIG. 1. The photosensitive drum 1 is, for example, a drum pipe 1*a* of aluminum of which the circumferential surface is laid with a photosensitive layer 1*b*. The photosensitive layer 1*b* is electrostatically charged by the charging device 2. Then, on the surface of the photosensitive layer 1*b*, when it receives laser light L from the exposing device 3 (see FIG. 1), an electrostatic latent image with attenuated electrostatic charge is formed.

Figure 3:
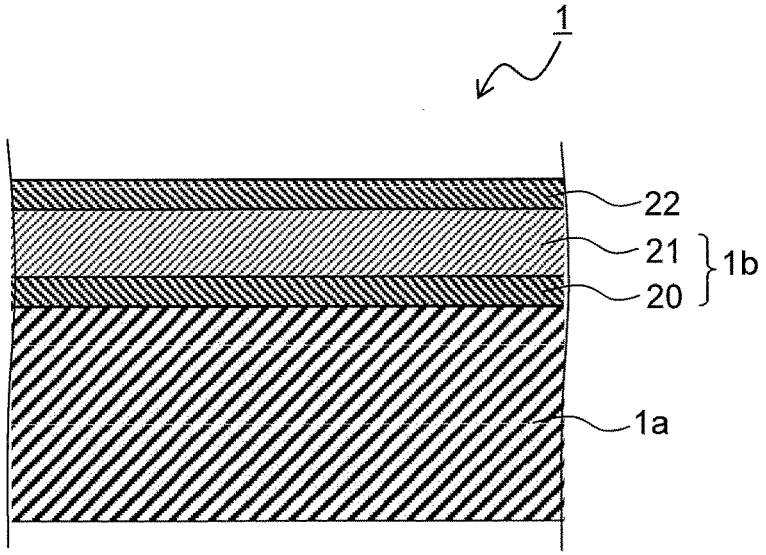
FIG. 3 is an enlarged sectional view of a photosensitive drum used in the image forming apparatus.

FIG. 3 is an enlarged sectional view of the photosensitive drum 1 used in the image forming apparatus 100. In this embodiment, the photosensitive drum 1 is an amorphous silicon photosensitive member that has, laid on a drum pipe 1*a* sequentially, a photosensitive layer 1*b* including an electric charge injection inhibition layer 20 comprising amorphous silicon containing boron or the like and a photoconductive layer 21 comprising amorphous silicon, and a surface protection layer 22 comprising amorphous carbon. The amorphous carbon forming the surface protection layer 22 contains fluorine. Owing to the provision of the surface protection layer 22 formed of amorphous carbon, the wear resistance and the print resistance of the surface of the photosensitive drum 1 are improved. Owing to the amorphous carbon containing fluorine, hydrophobicity on the surface of the photosensitive drum 1 is increased, adsorption of moisture on discharge products and the like attached to the surface of the photosensitive drum 1 is suppressed, and image quality degradation resulting from image deletion is prevented.

The amorphous carbon containing fluorine (hereinafter, referred to as a CF layer) forming the surface protection layer 22 is formed by amorphous carbon formed in a thin layer being irradiated and impregnated with fluorine by a thin-film forming technology such as sputtering, the CVD process, or the like. The formation of a thin layer and the irradiation with fluorine are repeated a plurality of times so that these are laminated on top of another to form a CF layer with a considerable depth. Thus, the fluorine content varies depending on the depth from the surface of the CF layer. Specifically, every time a thin layer is formed, it is irradiated and impregnated with fluorine; thus, in the CF layer, the fluorine content varies in the depth direction repeatedly such that the fluorine content sharply rises at each depth position subjected to irradiation with fluorine, and gradually decreases from the position subjected to irradiation with fluorine to a depth position subjected to previous irradiation with fluorine. It is known that the hardness of amorphous carbon decreases with fluorine. That is, the higher the fluorine content is, the lower the hardness of the CF layer is.

As described above, the fluorine content varies depending on the depth from the surface of the CF layer, and thus the hardness also varies depending on the depth from the surface of the CF layer. It is known that the higher the fluorine content of the CF layer is, the lower the friction resistance p of the surface of the CF layer is. That is, when the CF layer has a high fluorine content, the friction resistance p and the hardness of the surface of the CF layer are low, and when the CF layer has a low fluorine content, the friction resistance p and the hardness of the surface of the CF layer are high. Thus, when the friction resistance p of the surface of the CF layer is low, its hardness is low, and when the friction resistance p of the surface of the CF layer is high, its hardness is high. That is, when the friction resistance p of the surface of the CF layer is measured, the fluorine content or the hardness of the surface of the CF layer is also measured.

What is described above is in no way meant to limit the photosensitive drum 1; instead, the surface protection layer 22 may be formed of amorphous silicon carbide containing fluorine, or so long as a surface protection layer 22 is provided, the photosensitive drum 1 may be laid with an organic photosensitive layer (OPC) as the photosensitive layer 1*b*.

Examples of the material of the surface protection layer 22 formed on the photosensitive drum 1 laid with an organic photosensitive layer as the photosensitive layer 1*b* include a charge transport polymer and a charge transport cured film obtained by curing a thermoplastic resin dispersed with a charge transport material and an inorganic filler. As the surface protection layer 22, use may be made of a high-hardness crosslinked surface layer formed by curing a radical polymerizable oligomer having a polyester structure in the molecule, a radical polymerizable compound having no charge transport structure part, and a radical polymerizable compound having a charge transport structure part, or a charge transport cured film containing a polymerized material (or a crosslinked material) of a reactive charge transport material such as an allylamine derivative, and an antioxidant.

The charging device 2 has a charging roller 23 and a charge cleaning roller 25. The charging roller 23 is formed of, for example, electrically conductive rubber, and is arranged in contact with the photosensitive drum 1. As shown in FIG. 2, as the photosensitive drum 1 rotates in the counter-clockwise direction, the charging roller 23 in contact with the surface of the photosensitive drum 1 follows this by rotating in the clockwise direction. Here, a predetermined voltage is applied to the charging roller 23 so that the photosensitive layer 1*b* of the photosensitive drum 1 is electrostatically charged uniformly. As the charging roller 23 rotates, the charge cleaning roller 25 in contact with the charging roller 23 is driven to rotate in the counter-clockwise direction to remove foreign matter attached to the surface of the charging roller 23. Here, the charging roller 23 may be arranged close to the photosensitive drum 1. It is also possible to use a charging device 2 of a corona discharge type which is provided with a corona wire instead of the charging roller 23.

The developing device 4 has a developing roller 4*a* arranged opposite the photosensitive drum 1, and attaches toner containing a toner external additive (polishing particles) comprising metal particles such as titanium oxide, and thereby develops an electrostatic latent image formed on the surface of the photosensitive drum 1 into a toner image. As the developing device 4, a conventionally well-known one can be used.

The cleaning device 6 includes a collection spiral 61, a cleaning blade 62, a rubbing roller (cleaning roller) 63, and a scraper 64. The collection spiral 61 is arranged inside the housing in a lower part of it, and conveys, while rotating in a predetermined direction, collected toner to one side in the sheet width direction (the direction perpendicular to the plane of FIG. 2) so as to feed the toner to a waste toner container (unillustrated).

The cleaning blade 62 is fitted to the housing in a lower part of it, and is formed of urethane rubber or the like. A tip end of the cleaning blade 62 makes contact with the surface of the photosensitive drum 1 from a direction counter to the rotation direction of the photosensitive drum 1 (the counter-clockwise direction in FIG. 2).

The rubbing roller 63 is in contact with the surface of the photosensitive drum 1 on the upstream side of the cleaning blade 62 in the rotation direction of the photosensitive drum 1. The rubbing roller 63, while collecting the waste toner from the surface of the photosensitive drum 1, polishes the surface of the photosensitive drum 1 by use of the waste toner attached to the surface of the rubbing roller 63. To that end, the rubbing roller 63 is formed in a cylindrical shape extending in the recording sheet width direction by comprising an elastic layer 63*b* of foamed rubber (for example, carbon containing electrically conductive EPDM foam) formed around the circumferential surface of a metal core 63*a*. Owing to this elastic layer 63*b*, it is possible to polish the surface of the photosensitive drum 1 and to achieve a high waste toner holding ability. The rubbing roller 63 is driven to rotate by a driving motor 35 (see FIG. 4). The rotation direction of the rubbing roller 63 is the clockwise direction in FIG. 2, that is, the direction opposite to the rotation direction of the photosensitive drum 1 (the same direction at a part at which the rubbing roller 63 and the photosensitive drum 1 face each other, the trail direction), and the linear velocity of the rubbing roller 63 is 1.2 times higher than that of the photosensitive drum 1.

The scraper 64 is arranged over the rubbing roller 63 in contact with the surface of the rubbing roller 63 (the elastic layer 63*b*). As the scraper 64, a thin plate of metal such as stainless steel having sufficient durability is used. A tip end of the scraper 64 makes contact with the rubbing roller 63 from the downstream side of the rubbing roller 63 in its rotation direction (from the counter direction) to even out the amount of toner attached to the surface of the rubbing roller 63.

The destaticizer 7 is arranged on the downstream side of the cleaning device 6 in the rotation direction of the photosensitive drum 1. The destaticizer 7 uses LEDs (light-emitting diodes) to irradiate the photosensitive drum 1 with destaticizing light (erase light) so as to remove electric charge remaining on the surface of the photosensitive layer 1*b* in preparation for the electrostatic charging process in subsequent image formation.

Figure 4:
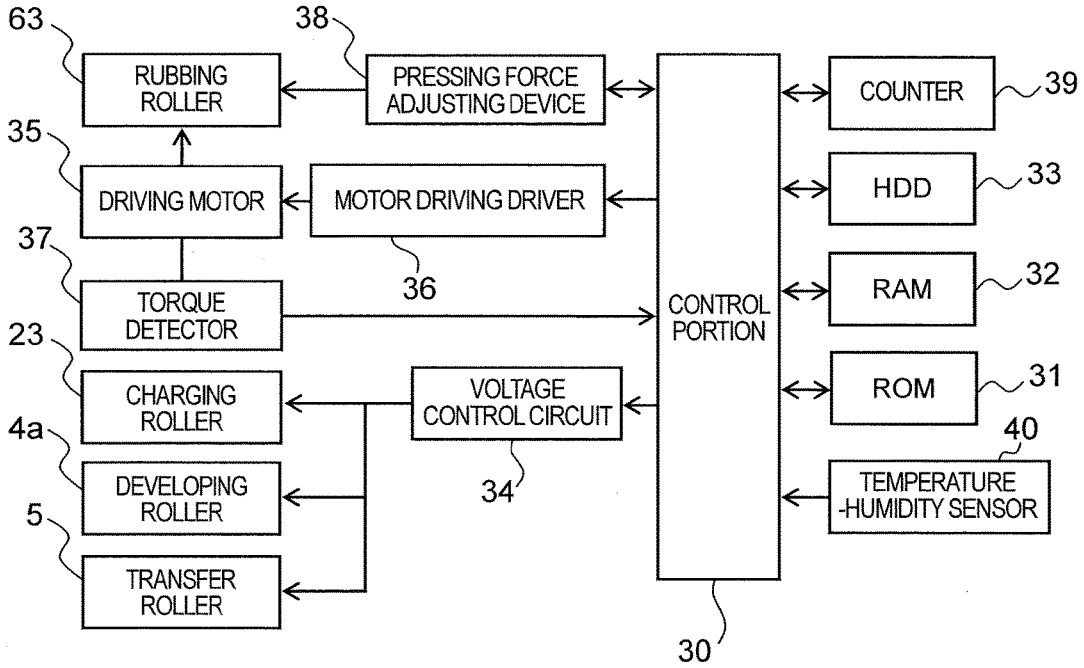
FIG. 4 is a block diagram showing an example of controlling channels in the image forming apparatus according to the first embodiment.

FIG. 4 is a block diagram showing an example of controlling channels in the image forming apparatus 100 according to the first embodiment. The control portion 30 controls the driving of the photosensitive drum 1 based on various control programs relating to image formation in general stored in ROM 31, RAM 32, or a HDD 33. In addition, the control portion 30 executes calibration as to the supply of toner to the developing device 4, application voltages from a voltage control circuit 34 which applies a charging voltage, a developing voltage, and a transfer voltage to the charging roller 23, the developing roller 4*a*, and the transfer roller 5 respectively, exposure conditions such as the laser power of the laser light L (see FIG. 2) emitted from the exposing device 3, the amount of erase light or the like emitted from the destaticizer 7, and the like. The control portion 30 is connected, via a motor driving driver 36, to a driving motor (driving device) 35 which drives the rubbing roller 63 to rotate, and the motor driving driver 36 controls the rotation speed and the rotation direction of the driving motor 35 based on a control signal from the control portion 30. In the ROM 31, there are also stored control programs relating to an image degradation suppression process executed in the image forming apparatus 100 according to the present disclosure.

A torque detector 37 detects the rotational torque of the rubbing roller 63. For the rotational torque of the rubbing roller 63, detection of an output current from the driving motor 35 can be substitute. That is, in this embodiment, the output current from the driving motor 35 is used as an index representing a torque. The method for detecting the torque of the driving motor 35 is not limited to one that involves detecting the output current from the driving motor 35; instead, the torque of the rotation shaft of the driving motor 35 may be directly detected by a torque sensor. A pressing force adjusting device 38 adjusts the pressing force of the rubbing roller 63 acting on the photosensitive drum 1 based on a control signal from the control portion 30. A counter 39 counts the cumulative number of printed sheets.

A temperature-humidity sensor 40 detects the temperature and humidity around the photosensitive drum 1 inside the image forming apparatus 100. The results of detection are transmitted to the control portion 30.

In the image forming apparatus 100 according to this embodiment, when no image is being formed, a photosensitive member polishing mode can be executed as necessary in which toner is discharged from the developing device 4 to the photosensitive drum 1, the discharged toner is fed to the rubbing roller 63, and the surface of the photosensitive drum 1 is polished. Specifically, a developing voltage having the same polarity (positive) as toner is applied to the developing roller 4*a* in the developing device 4 so that toner to be used for polishing the surface of the photosensitive drum 1 is fed from the developing device 4 to the photosensitive drum 1 (toner feeding process). While toner is being fed to the rubbing roller 63, to prevent toner from attaching to the transfer roller 5, a voltage (reverse transfer voltage) having the same polarity (positive) as toner is applied to the transfer roller 5.

After the toner is fed to the photosensitive drum 1, the rubbing roller 63 is rotated with a linear velocity difference from that of the photosensitive drum 1 to polish the surface of the photosensitive drum 1 and remove moisture and discharge products together with toner from the surface of the photosensitive drum 1 (polishing process). Even after toner stops being fed from the developing roller 4*a*, the photosensitive drum 1 and the rubbing roller 63 continue to rotate further for a while.

By executing the above-described photosensitive member polishing mode including the toner feeding process and the polishing process for a previously set duration or a previously set number of times counted in cycles of the toner feeding process and the polishing process each performed once, it is possible to remove moisture and discharge products from the surface of the photosensitive drum 1, and thus to effectively prevent image deletion over a long period of time. The execution duration or the number of repeated cycles of the photosensitive member polishing mode is set appropriately according to the configuration of the photosensitive layer 1*b* of the photosensitive drum 1 used, the use environment of the image forming apparatus 100, and the like.

Now, a description will be given of the distinctive features of the image forming apparatus 100 according to the present disclosure. In the above-described configuration, the control portion 30 controls the driving motor 35 which rotates the rubbing roller 63 via the motor driving driver 36, and estimates the surface condition of the photosensitive drum 1 based on the rotational torque (driving torque) of the rubbing roller 63 detected by the torque detector 37.

The rubbing roller 63 is in contact with the photosensitive drum 1 and the scraper 64 which scrapes toner off the rubbing roller 63. The scraper 64 is made of sheet metal, and thus changes little over time or with the environment; accordingly, the torque of the rubbing roller 63 hardly varies due to the scraper 64. Rather, owing to the scraper 64 being in contact with the rubbing roller 63, the stability of the rotational torque of the rubbing roller 63 is enhanced. Thus, when the friction resistance of the surface of the photosensitive drum 1 varies, the rotational torque of the rubbing roller 63 varies more easily with the variation in the friction resistance; this makes it easy to detect a variation in the friction resistance. That is, monitoring the variation in the torque of the rubbing roller 63 makes it possible to keep track of the surface condition of the photosensitive drum 1.

When the rubbing roller 63 is brush-shaped, inconveniently, its bristles bend and toner gets between the bristles, and when the rubbing roller 63 is a foam roller, inconveniently, the roller wears and toner gets into foam cells. In either case, it is impossible to accurately measure the torque variation of the rubbing roller 63. If the charging roller 23, which is in contact with the photosensitive drum 1 like the rubbing roller 63, is rotated with a linear velocity difference from that of the photosensitive drum 1, uneven charge distribution results; to prevent that, the charging roller 23 is made to rotate by following the photosensitive drum 1 as it rotates. Thus, it is difficult to accurately detect the rotational torque. The transfer roller 5 is contaminated with paper dust and toner, and thus its surface condition easily varies; this makes it impossible to stably measure the rotational torque. Thus, by detecting the rotational torque of, of all the members in contact with the photosensitive drum 1, the rubbing roller 63 which has the elastic layer 63*b*, the most accurate torque detection is achieved.

In this embodiment, a rubbing roller 63 with a diameter of 15.5 mm is used which has, as the elastic layer 63*b*, an EPDM rubber layer with a thickness of 1.75 mm, an Asker C hardness of 57±5°, and a resistance value of 8.7 (log Ω) or lower laid on the circumferential surface of a metal core 63*a* with a diameter of 12 mm. The rubbing roller 63 is rotated at a linear velocity 1.2 times higher (at a linear velocity of 72 to 420 mm/sec) than that of the photosensitive drum 1 (with a diameter of 30 mm and a linear velocity of 60 to 350 mm/sec) in the trail direction with respect to the photosensitive drum 1.

Image degradation suppression control is performed according to the surface condition of the photosensitive drum 1 estimated from the rotational torque of the rubbing roller 63 detected by the torque detector 37. Next, specific examples of image degradation suppression control will be described.

First Control Example

First, a description will be given of a first control example of image degradation suppression control. In the first control example, when the rotational torque of the rubbing roller 63 detected by the torque detector 37 is high, polishing conditions are changed to increase the polishing amount; when the rotational torque is low, polishing conditions are changed to reduce the polishing amount. In the first control example, the polishing conditions which can be changed include the linear velocity of the rubbing roller 63, the pressing force of the rubbing roller 63 against the photosensitive drum 1, and whether or not the photosensitive member polishing mode is executed.

Figure 5:
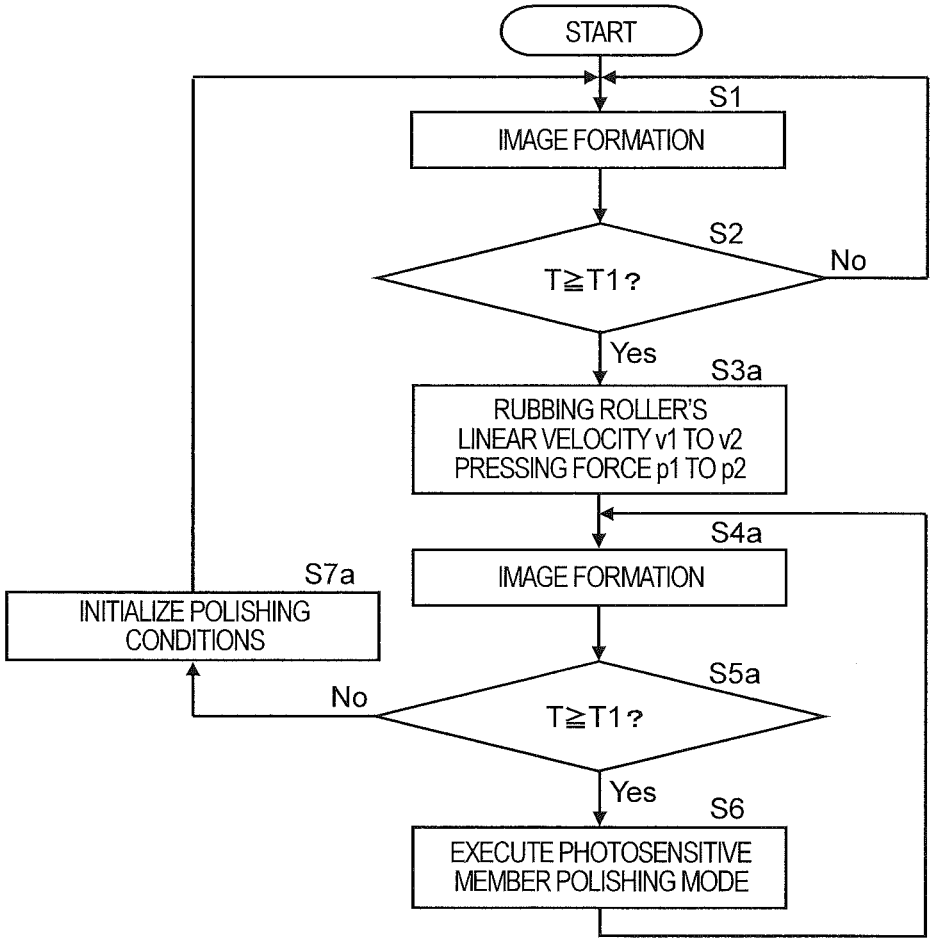
FIG. 5 is a flow chart showing a first control example of image degradation suppression control in the image forming apparatus according to the first embodiment.

FIG. 5 is a flow chart showing the first control example of image degradation suppression control in the image forming apparatus 100 according to the first embodiment. With reference to FIGS. 1 to 4 as necessary, the first control example will be described along the steps in FIG. 5.

First, regular image formation is performed (Step S1). Here, during image formation in the image forming apparatus 100, the rubbing roller 63 is pressed against the photosensitive drum 1 with a pressing force p1, and is rotated at a linear velocity v1, which is higher than the linear velocity V of the photosensitive drum 1, in the same direction (the trail direction) at the part at which the rubbing roller 63 and the photosensitive drum 1 face each other as shown in FIG. 2, so as to thereby remove the toner left unused on the surface of the photosensitive drum 1 and polish the surface of the photosensitive drum 1. Here, the rotational torque T of the rubbing roller 63 is detected by the torque detector 37. When the image formation at Step S1 is completed, the flow proceeds to Step S2.

To raise the sensitivity of detecting the rotational torque of the rubbing roller 63, it is preferable that the rotation direction of the rubbing roller 63 be the direction (the counter direction) opposite to that of the photosensitive drum 1 at the part at which the rubbing roller 63 and the photosensitive drum 1 face each other. When the rotation direction of the rubbing roller 63 is the opposite direction, the rubbing load and its variation are less influential, and thus jitter, in which stripes appear in an image due to irregular rotation and a deviation in the rotation position, or the like is less likely to occur. When the rotation direction of the rubbing roller 63 is the opposite direction, the amount by which the surface of the photosensitive drum 1 is scraped increases; thus, with consideration given to the life of the photosensitive drum 1, during regular printing, the rubbing roller 63 is preferably rotated in the same direction (the trail direction) at the part at which the rubbing roller 63 and the photosensitive drum 1 face each other, and is preferably rotated in the opposite direction (the counter direction) only when the rotational torque of the rubbing roller 63 is detected.

The linear velocity v1 of the rubbing roller 63 may be lower than the linear velocity V of the photosensitive drum 1 so long as the linear velocity v1 does not equal the linear velocity V. That is, a relative linear velocity difference between the rubbing roller 63 and the photosensitive drum 1 needs to produce a friction state at a place where they are in contact with each other.

Next, the control portion 30 checks whether or not the rotational torque of the rubbing roller 63 detected by the torque detector 37 is equal to or higher than a predetermined value T1 (Step S2). If the rotational torque T is lower than the predetermined value T1 (No in Step S2), the flow returns to Step S1, where image formation is performed, and thereafter Step S2 is repeated. Image formation continues to be performed until the rotational torque T becomes equal to or higher than the predetermined value T1.

The predetermined value T1 is influenced by the depth to which the rubbing roller 63 is pressed onto the photosensitive drum 1 and the hardness of the photosensitive drum 1, and is thus previously set and stored in the HDD (memory) 33 with consideration given to the material of the photosensitive drum 1, the surface roughness of the photosensitive drum 1 observed before factory shipment (before the start of use), the materials of the cleaning blade 62 and the rubbing roller 63, and the like. At factory shipment, shipment is performed in a state where the surface of the rubbing roller 63 is covered with toner or the like; this results in a large variation in the torque of the rubbing roller 63 at the start of use. Thus, it is preferable to use, as the predetermined value T1, a torque value observed after a predetermined number of sheets have been printed.

Like the driving torque of the photosensitive drum 1, the rotational torque of the rubbing roller 63 varies with environmental conditions, and thus it is preferable to perform predetermined correction on the measurement value according to the temperature and humidity inside the image forming apparatus 100 detected by the temperature-humidity sensor 40 (see FIG. 4). On the other hand, the torque variation of the rubbing roller 63 occurring due to the temperature and humidity is very small as compared with the torque variation of the photosensitive drum 1.

If the rotational torque T is equal to or higher than the predetermined value T1 (Yes in Step S2), the flow proceeds to Step S3*a*. The rotational torque T being equal to or higher than the predetermined value T1 means that the friction coefficient μ of the surface of the photosensitive drum 1 is high. That is, as described above, the hardness of the surface protection layer 22 is high (the fluorine content is low), and thus the polishing conditions are changed to increase the polishing amount.

At Step S3*a*, the linear velocity of the rubbing roller 63 is changed from v1 to v2 (v1<v2) to increase its difference from the linear velocity V of the photosensitive drum 1, and the pressing force of the rubbing roller 63 is changed from p1 to p2 (p1<p2) to increase the polishing amount. Instead, only either of the following may be performed: increasing the linear velocity difference from the linear velocity V of the photosensitive drum 1 by changing the linear velocity of the rubbing roller 63 from v1 to v2, and changing the pressing force of the rubbing roller 63 from p1 to p2. When the linear velocity v1 of the rubbing roller 63 is lower than the linear velocity V of the photosensitive drum 1, the linear velocity difference from the linear velocity V of the photosensitive drum 1 may be increased by reducing the linear velocity v2 to be lower than v1.

Changing the polishing conditions as described above increases the polishing amount per unit time, and thus it is possible to increase the polishing amount without changing the polishing duration. Thus, it is possible to reduce the frequency of executing the photosensitive member polishing mode when no image is formed, and thus to minimize a drop in the success rate (productivity) of forming images in the image forming apparatus 100. In FIG. 5, although changing the polishing conditions by changing both the linear velocity and the pressing force is taken as one step, it may be performed in separate steps. After the polishing conditions are changed, the flow proceeds to Step S4*a*.

Next, as in Step S1, image formation is performed (Step S4*a*). Here, the rubbing roller 63 is pressed against the photosensitive drum 1 with a pressing force p2, and is rotated at a linear velocity v2, which is higher than the linear velocity V of the photosensitive drum 1, in the same direction (the trail direction) at the part at which the rubbing roller 63 and the photosensitive drum 1 face each other, so as to thereby remove the toner left unused on the surface of the photosensitive drum 1 and polish the surface of the photosensitive drum 1. Then, while image formation is being performed, the rotational toque T of the rubbing roller 63 is detected by the torque detector 37. When the image formation at Step S4*a* is completed, the flow proceeds to Step S5*a*.

Next, the control portion 30 checks whether or not the rotational torque of the rubbing roller 63 detected by the torque detector 37 is equal to or higher than the predetermined value T1 (Step S5*a*). If the rotational torque T is equal to or higher than the predetermined value T1 (Yes in Step S5*a*), the flow proceeds to Step S6.

If, at Step S5*a*, the rotational torque T is equal to or higher than the predetermined value T1, this means that, even after the polishing conditions are changed to increase the polishing amount at Step S1*a*, the surface of the photosensitive drum 1 is insufficiently polished, and the friction coefficient μ is still high. Thus, the polishing conditions are changed again to increase the polishing amount. Specifically, in addition to the polishing performed during image formation, after the image formation, when no image is being formed, the photosensitive member polishing mode is executed in which toner is discharged from the developing device 4 to the photosensitive drum 1, and the photosensitive drum 1 and the rubbing roller 63 are driven to rotate (Step S6). In the photosensitive member polishing mode, to efficiently polish the surface of the photosensitive drum 1, the execution duration may be lengthened according to the magnitude of the rotational torque T, or the rubbing roller 63 may be rotated in the opposite direction (the counter direction) at the part at which the rubbing roller 63 and the photosensitive drum 1 face each other.

Figure 7:
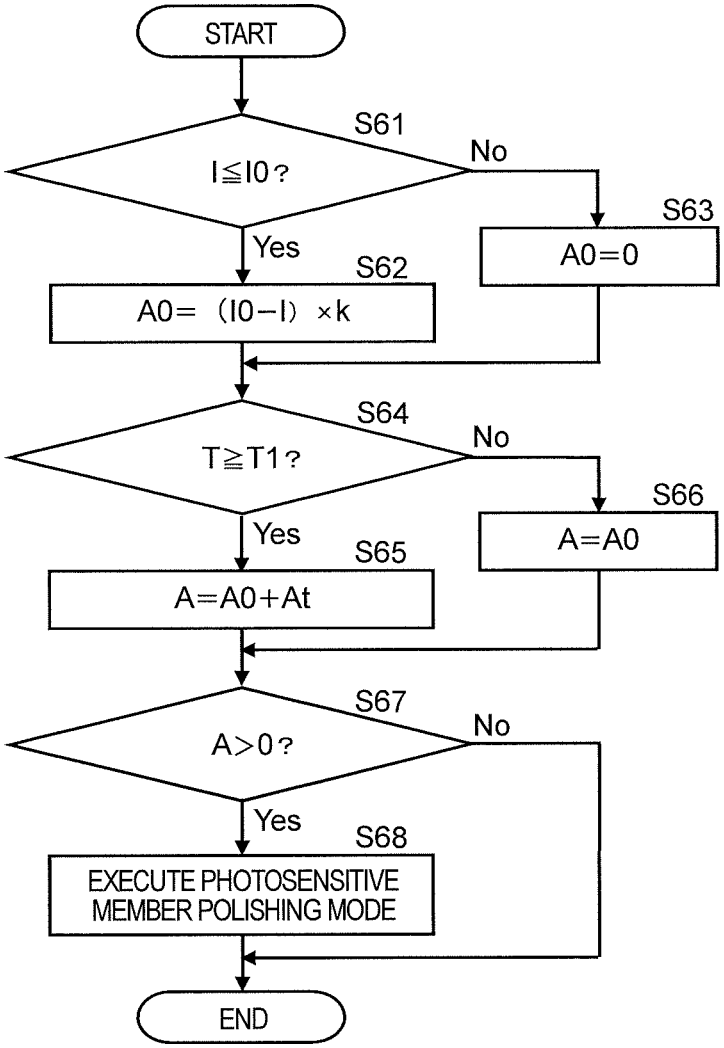
FIG. 7 is a flow chart showing an example of photosensitive member polishing-mode execution control in the second control example.

As shown in FIG. 7, which will be described later, the photosensitive member polishing mode can be occasionally executed for the purpose of discharging deteriorated toner on the developing roller 4*a* if the average printing ratio I per predetermined number of sheets is equal to or lower than a predetermined value. Although, in the first control example, if the rotational torque T is equal to or higher than the predetermined value T1 at Step S5*a*, the photosensitive member polishing mode is executed independently irrespective of the average printing ratio; instead, as shown in FIG. 7, whether or not the photosensitive member polishing mode is executed and the amount of toner discharged in the photosensitive member polishing mode may be determined based on the average printing ratio I and the rotational torque T.

By executing the photosensitive member polishing mode as described above, it is possible to reliably polish the surface of the photosensitive drum 1 and to reliably remove discharge products and the like attached to the surface of the photosensitive drum 1 leading to image deletion. After the photosensitive member polishing mode is executed, the flow returns to Step S4*a*, where image formation as well as the polishing process during image formation is performed, and then, the process at Step S5*a* is executed again.

If, at Step S5*a*, the rotational torque T is lower than the predetermined value T1 (No in Step S5*a*), this means that, by changing the polishing conditions to increase the polishing amount at Step S3*a* or by executing the photosensitive member polishing mode at Step S6, the surface of the photosensitive drum 1 is sufficiently polished and the friction resistance p is lowered. That is, the hardness of the surface of the photosensitive drum 1 is also lowered accordingly, and thus the polishing conditions changed at Step S3*a* are initialized (Step S7*a*).

Specifically, the polishing conditions are changed back such that the rubbing roller 63 has a linear velocity v1 and a pressing force p1. This helps prevent the life of the photosensitive drum 1 from being shortened as a result of a low-hardness part (a part with a high fluorine content, in which image deletion is less likely to occur) of the surface protection layer 22 being polished more than necessary.

Second Control Example

Next, a description will be given of a second control example of image degradation suppression control. In the second control example, according to the rotational torque of the rubbing roller 63 detected by the torque detector 37, the amount of toner fed to the rubbing roller 63 is adjusted. Specifically, when the rotational torque of the rubbing roller 63 is high, the toner feeding amount to the rubbing roller 63 is increased; when the rotational torque is low, the toner feeding amount to the rubbing roller 63 is decreased. One method for changing the toner feeding amount to the rubbing roller 63 is adjusting the developing voltage applied to the developing roller 4*a* or the transfer voltage applied to the transfer roller 5. When the photosensitive member polishing mode is executed, another method is adjusting the amount of toner discharged from the developing device 4.

Figure 6:
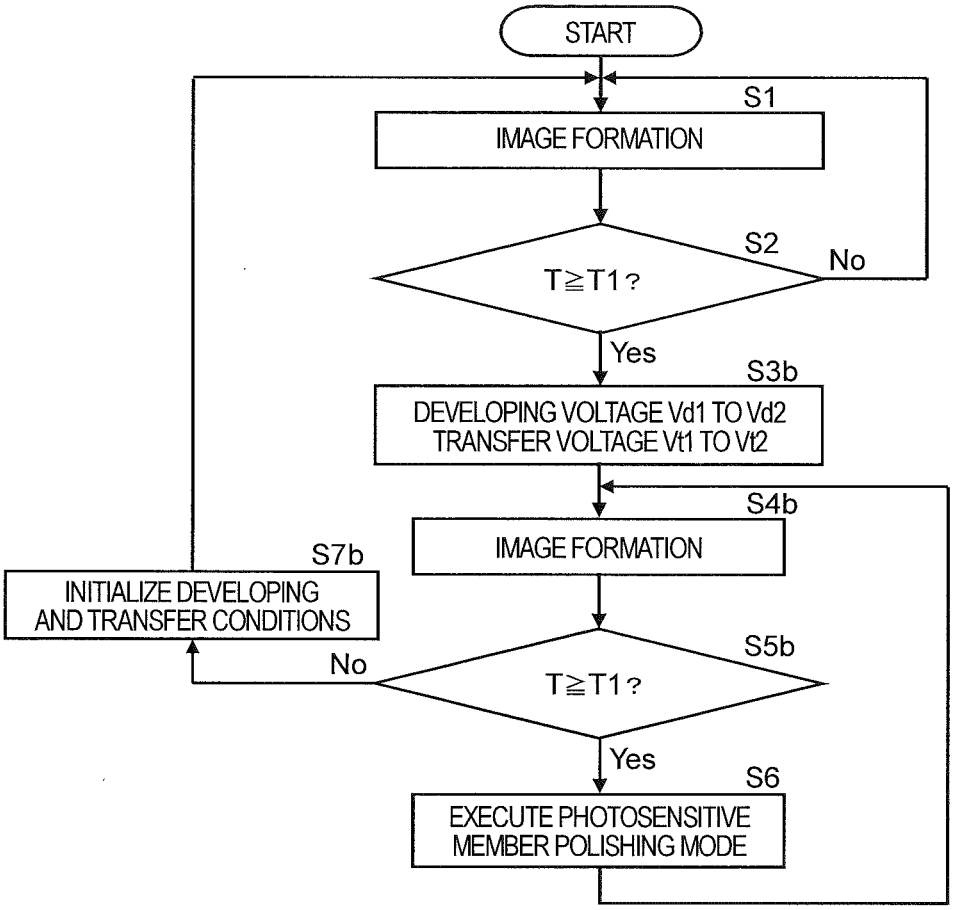
FIG. 6 is a flow chart showing a second control example of image degradation suppression control in the image forming apparatus according to the first embodiment.

FIG. 6 is a flow chart showing the second control example of image degradation suppression control in the image forming apparatus 100 according to the first embodiment. With reference to FIGS. 1 to 4 as necessary, the second control example will be described along the steps in FIG. 6. The rotation direction and the linear velocity of the rubbing roller 63, the pressing force of the rubbing roller 63 against the photosensitive drum 1, and the predetermined value T1 of the rotational torque of the rubbing roller 63 are determined in the same manner as in the first control example.

First, regular image formation is performed (Step S1). Here, the rotational torque T of the rubbing roller 63 is detected by the torque detector 37. When the image formation at Step S1 is completed, the flow proceeds to Step S2.

Next, the control portion 30 checks whether or not the rotational torque of the rubbing roller 63 detected by the torque detector 37 is equal to or higher than a predetermined value T1 (Step S2). If the rotational torque T is equal to or higher than the predetermined value T1 (Yes in Step S2), the flow proceeds to Step S3*b*. The rotational torque T being equal to or higher than the predetermined value T1 means that the friction coefficient μ of the surface of the photosensitive drum 1 is high. That is, as described above, the hardness of the surface protection layer 22 is high (the fluorine content is low), and thus the polishing conditions are changed to increase the polishing amount.

At Step S3*b*, the developing voltage applied to the developing roller 4*a* is changed from Vd1 to Vd2 (Vd1<Vd2), and the transfer voltage applied to the transfer roller 5 is changed from Vt1 to Vt2 (Vt1>Vt2) to increase the toner feeding amount. Instead, only either of the following may be performed: changing (increasing) the developing voltage from Vd1 to Vd2, and changing (decreasing) the transfer voltage from Vt1 to Vt2. However, as in this control example, changing both the developing voltage and the transfer voltage results in a small variation in print density, and is thus preferable.

Changing the polishing conditions as described above increases the toner feeding amount to the rubbing roller 63, and increases the polishing amount per unit time accordingly, and thus it is possible to increase the polishing amount without lengthening the polishing duration. Thus, it is possible to minimize a drop in the success rate (productivity) of forming images in the image forming apparatus 100 caused by the photosensitive member polishing mode being executed when no image is being formed. If, at Step S2, the rotational torque T is lower than the predetermined value T1 (No in Step S2), the flow returns, without changing the developing voltage Vd1 or the transfer voltage Vt1, to Step S1, where image formation is performed, and thereafter Step S2 is repeated.

Next, as in Step S1, image formation is performed (Step S4*b*). Here, the rubbing roller 63, while removing the toner left unused on the surface of the photosensitive drum 1, polishes the surface of the photosensitive drum 1. Then, while image formation is being performed, the rotational toque T of the rubbing roller 63 is detected by the torque detector 37. When the image formation at Step S4*b* is completed, the flow proceeds to Step S5*b*.

Next, the control portion 30 checks whether or not the rotational torque of the rubbing roller 63 detected by the torque detector 37 is equal to or higher than the predetermined value T1 (Step S5*b*).

If, at Step S5*b*, the rotational torque T is equal to or higher than the predetermined value T1, this means that, even after the developing condition and the transfer condition are changed to increase the toner feeding amount to the rubbing roller 63 at Step S3*b*, discharge products on the surface of the photosensitive drum 1 are insufficiently removed, and the friction coefficient μ is still high. Thus, the polishing conditions are changed again to increase the polishing amount. Specifically, in addition to the polishing performed during image formation, after the image formation, when no image is being formed, the photosensitive member polishing mode is executed in which toner is discharged from the developing device 4 to the photosensitive drum 1, and the photosensitive drum 1 and the rubbing roller 63 are driven to rotate (Step S6).

By executing the photosensitive member polishing mode as described above, it is possible to reliably polish the surface of the photosensitive drum 1 and to reliably remove discharge products and the like attached to the surface of the photosensitive drum 1 leading to image deletion. After the photosensitive member polishing mode is executed, the flow returns to Step S4*b*, where image formation as well as the polishing process during image formation is performed, and then, the process at Step S5*b* is executed again.

If, at Step S5*b*, the rotational torque T is lower than the predetermined value T1 (No in Step S5*b*), this means that, by changing the developing condition and the transfer condition at Step S3*b* or by executing the photosensitive member polishing mode at Step S6, production of discharge products and their attachment to the photosensitive drum 1 are suppressed and the friction resistance p is lowered. That is, the hardness of the surface protection layer 22 of the photosensitive drum 1 is also lowered accordingly, and thus the developing condition and the transfer condition changed at Step S3*b* are initialized (Step S7*b*). Specifically, the developing voltage is changed from Vd2 back to Vd1, and the transfer voltage is changed from Vt2 back to Vt1. This helps prevent toner from being fed excessively to the photosensitive drum 1.

FIG. 7 is a flow chart showing an example of photosensitive member polishing-mode execution control in the second control example shown in FIG. 6. Along the steps in FIG. 7, a description will be given of a procedure for increasing the toner feeding amount to the rubbing roller 63 in the photosensitive member polishing mode.

When images having low printing ratios are printed successively, deterioration of toner carried on the developing roller 4*a* is accelerated, and thus, it is necessary to discharge toner from the developing roller 4*a* to the photosensitive drum 1. That is, determining the amount of toner discharged to the photosensitive drum 1 in the photosensitive member polishing mode involves another factor (the printing ratio) other than the surface condition of the photosensitive drum 1. Thus, the control portion 30 calculates the average printing ratio I every predetermined number of printed sheets, and checks whether or not the average printing ratio I is equal to or lower than the predetermined value (threshold value) I0 (Step S61).

If the average printing ratio I is equal to or lower than the predetermined value I0 (Yes in Step S61), the toner discharge amount A0 [mm] is, as a toner discharge amount (toner discharge duration) based on the factor of the printing ratio, determined by multiplying the difference (I0−I) between the average printing ratio I and the predetermined value I0 by the coefficient k (Step S62). On the other hand, if the average printing ratio I is higher than the predetermined value I0 (No in Step S61), it is unnecessary to discharge toner based on the factor of the printing ratio, and thus the toner discharge amount is set such that A0=0 [mm] (Step S63).

Next, the control portion 30 checks whether or not the rotational torque of the rubbing roller 63 detected by the torque detector 37 is equal to or higher than the predetermined value T1 (Step S64). If, at Step S64, the rotational torque T is equal to or higher than the predetermined value T1 (Yes in Step S64), this means that, even after the developing condition and the transfer condition are changed to increase the polishing amount at Step S3 in FIG. 6, the surface of the photosensitive drum 1 is insufficiently polished, and the friction coefficient μ is still high. Thus, in the photosensitive member polishing mode executed when no image is being formed after image formation, the polishing conditions are changed again to increase the polishing amount.

Specifically, to yield an actual toner discharge amount with consideration given to the surface condition of the photosensitive drum 1, the toner discharge amount A [mm] is determined by adding the predetermined value At [mm] to the toner discharge amount A0 [mm] based on the average printing ratio I determined at Step S62 or Step S63 (Step S65). The predetermined value At [mm] varies with the rotational torque T; specifically, the higher the rotational torque T is, the higher the predetermined value At [mm] is made to increase the toner discharge amount A [mm]. Here, although, as a method for increasing the toner discharge amount, one that involves lengthening the toner discharge duration is used; instead, one that involves increasing the developing voltage applied to the developing roller 4*a* may be used.

On the other hand, if, at Step S64, the rotational torque T is lower than the predetermined value T1 (No in Step S64), this means that, by changing the developing condition and the transfer condition to increase the polishing amount at Step S3 in FIG. 6, the surface of the photosensitive drum 1 is sufficiently polished, and the friction resistance p is lowered. That is, the hardness of the surface protection layer 22 of the photosensitive drum 1 is also lowered accordingly, and thus the discharge amount A0 [mm] determined at Step S62 or Step S63 is, as it is, set as an actual toner discharge amount A [mm] (Step S66).

Then, it is checked whether or not the toner discharge amount A [mm] determined at Step S65 or Step S66 is higher than 0 [mm] (Step S67). That is, at least either when the average printing ratio I is equal to or lower than the predetermined I0 or when the rotational torque T is equal to or higher than the predetermined value T1, A>0 (Yes in Step S67); thus, the photosensitive member polishing mode is executed in which the toner discharge amount A [mm] of toner is discharged from the developing roller 4*a* to the photosensitive drum 1, and the photosensitive drum 1 and the rubbing roller 63 are driven to rotate (Step S68).

On the other hand, if the average printing ratio I is higher than the predetermined value I0, and the rotational torque T is lower than the predetermined value T1, A=0 (No in Step S67); thus, the flow ends without the photosensitive member polishing mode being executed. As described above, based on the average printing ratio I and the rotational torque T of the rubbing roller 63, the toner feeding amount in the photosensitive member polishing mode can be determined properly.

With the above-described first and second control examples, by measuring the rotational torque of the rubbing roller 63, as compared with a case where the driving torque of the photosensitive drum 1 is measured, the torque variation resulting from wear is reduced, and a variation in the friction resistance p of the surface of the photosensitive drum 1 can be detected more accurately. As a result, it is possible to properly polish the surface protection layer 22 of the photosensitive drum 1, to maintain image quality by preventing image deletion until the end of the useful life of the photosensitive drum 1, and to achieve a prolonged life of the photosensitive drum 1.

Third Control Example

Next, a description will be given of a third control example of image degradation suppression control. In the third control example, according to the rotational torque of the rubbing roller 63 detected by the torque detector 37, the charging voltage applied to the charging roller 23 is adjusted. Generally, when an amorphous silicon photosensitive member is electrostatically charged, an AC voltage is used as the charging voltage applied to the charging roller 23. The Vpp (peak-to-peak value; the difference between the maximum voltage and the minimum voltage) of the AC voltage is varied with the rotational torque of the rubbing roller 63. When it is presumed that the rotational torque is higher than a reference value and that discharge products increase, the Vpp is controlled to be lower than the reference value to reduce the amount of discharge products produced during image formation. By performing the control to polish the surface of the photosensitive drum 1 (to scrape off the discharge products) in this state, it is possible to more effectively remove discharge products by polishing during image formation and in the photosensitive member polishing mode as compared with a case where the Vpp is not lowered. Lowering the Vpp makes uneven charge distribution more likely to occur on the photosensitive drum 1, and thus the Vpp should not be lowered more than necessary.

Figure 8:
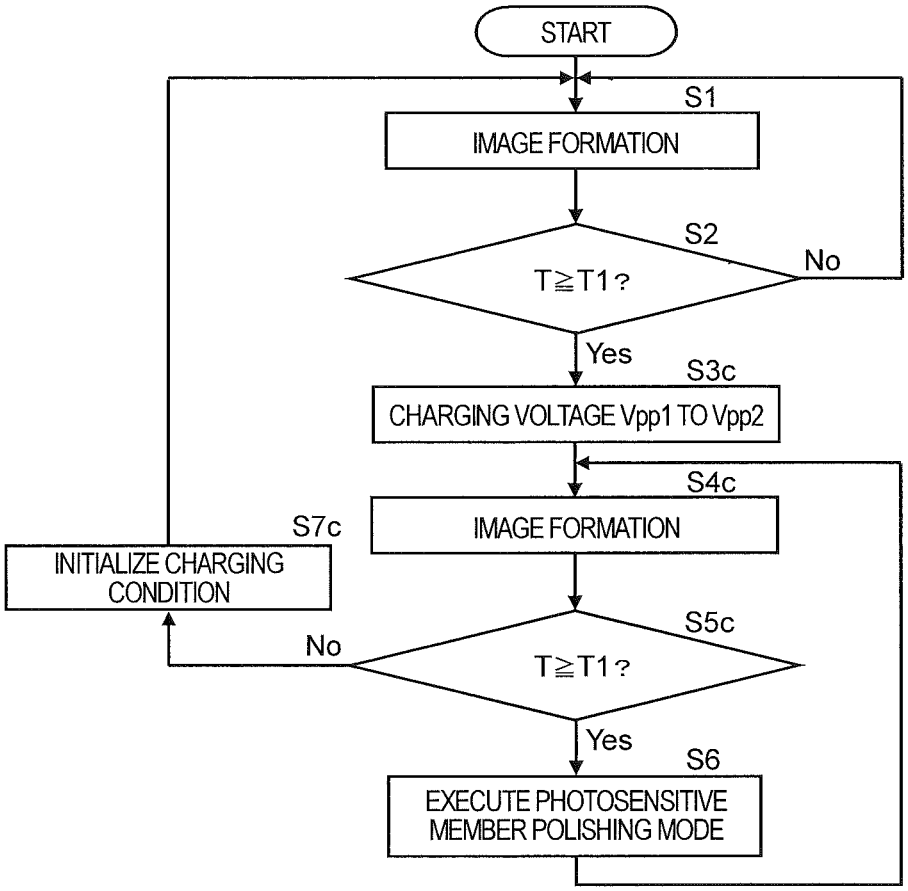
FIG. 8 is a flow chart showing a third control example of image degradation suppression control in the image forming apparatus according to the first embodiment.

FIG. 8 is a flow chart showing the third control example of image degradation suppression control in the image forming apparatus 100 according to the first embodiment. With reference to FIGS. 1 to 4 as necessary, the third control example will be described along the steps in FIG. 8. The rotation direction and the linear velocity of the rubbing roller 63, the pressing force of the rubbing roller 63 against the photosensitive drum 1, and the predetermined value T1 of the rotational torque of the rubbing roller 63 are determined in the same manner as in the first and second control examples.

First, regular image formation is performed (Step S1). Here, the rotational torque T of the rubbing roller 63 is detected by the torque detector 37. When the image formation at Step S1 is completed, the flow proceeds to Step S2.

Next, the control portion 30 checks whether or not the rotational torque of the rubbing roller 63 detected by the torque detector 37 is equal to or higher than a predetermined value T1 (Step S2). If the rotational torque T is lower than the predetermined value T1 (No in Step S2), the flow returns to Step S1, where image formation is performed, and thereafter Step S2 is repeated. Image formation continues to be performed until the rotational torque T becomes equal to or higher than the predetermined value T1.

If the rotational torque T is equal to or higher than the predetermined value T1 (Yes in Step S2), the flow proceeds to Step S3*c*. The rotational torque T being equal to or higher than the predetermined value T1 means that the friction coefficient μ of the surface of the photosensitive drum 1 is high. That is, as described above, the hardness of the surface protection layer 22 is high (the fluorine content is low), and thus the charging condition is changed to reduce the production amount of discharge products attached to the photosensitive drum 1.

At Step S3*c*, the Vpp of the charging voltage applied to the charging roller 23 is changed from Vpp1 to Vpp2 (Vpp1>Vpp2). Changing the Vpp of the charging voltage as described above reduces the amount of discharge products produced during image formation, and thus it is possible to remove the discharge products attached to the photosensitive drum 1 with the rubbing roller 63 in a shorter time. Thus, even when polishing is performed when no image is being formed, the success rate (productivity) of forming images in the image forming apparatus 100 is not reduced. After the charging voltage is changed, the flow proceeds to Step S4*c*.

Next, as in Step S1, image formation is performed (Step S4*c*). Here, the rubbing roller 63, while removing the toner left unused on the surface of the photosensitive drum 1, polishes the surface of the photosensitive drum 1. Then, while image formation is being performed, the rotational toque T of the rubbing roller 63 is detected by the torque detector 37. When the image formation at Step S4*c* is completed, the flow proceeds to Step S5*c*.

Next, the control portion 30 checks whether or not the rotational torque of the rubbing roller 63 detected by the torque detector 37 is equal to or higher than the predetermined value T1 (Step S5*c*).

If, at Step S5*c*, the rotational torque T is equal to or higher than the predetermined value T1, this means that, even after the charging condition is changed to reduce the production amount of discharge products at Step S3*c*, discharge products on the surface of the photosensitive drum 1 are insufficiently removed, and the friction coefficient μ is still high. Thus, the polishing conditions are changed again to increase the polishing amount. Specifically, in addition to the polishing performed during image formation, after the image formation, when no image is being formed, the photosensitive member polishing mode is executed in which toner is discharged from the developing device 4 to the photosensitive drum 1, and the photosensitive drum 1 and the rubbing roller 63 are driven to rotate (Step S6).

By executing the photosensitive member polishing mode as described above, it is possible to reliably polish the surface of the photosensitive drum 1 and to reliably remove discharge products and the like attached to the surface of the photosensitive drum 1 leading to image deletion. After the photosensitive member polishing mode is executed, the flow returns to Step S4*c*, where image formation as well as the polishing process during image formation is performed, and then, the process at Step S5*c* is executed again.

Although, in the third control example, as in the first control example, if the rotational torque T is equal to or higher than the predetermined value T1 at Step S5*c*, the photosensitive member polishing mode is executed independently irrespective of the average printing ratio; instead, as shown in FIG. 7, whether or not the photosensitive member polishing mode is executed and the amount of toner discharged in the photosensitive member polishing mode may be determined based on the average printing ratio I and the rotational torque T.

If, at Step S5*c*, the rotational torque T is lower than the predetermined value T1 (No in Step S5*c*), this means that, by changing the charging condition at Step S3*c* or by executing the photosensitive member polishing mode at Step S6, production of discharge products and their attachment to the photosensitive drum 1 are suppressed and the friction resistance p is lowered. That is, the hardness of the surface protection layer 22 of the photosensitive drum 1 is also lowered accordingly, and thus the charging condition changed at Step S3*c* is initialized (Step S7*c*). Specifically, the Vpp of the charging voltage is changed from Vpp2 back to Vpp1. This helps prevent uneven charge distribution from being more likely to occur on the photosensitive drum 1 due to a drop in the charging voltage.

With the above-described third control example, by measuring the rotational torque of the rubbing roller 63, as compared with a case where the driving torque of the photosensitive drum 1 is measured, the torque variation resulting from wear is reduced, and a variation in the friction resistance p of the surface of the photosensitive drum 1 can be detected more accurately. As a result, it is possible to properly control the charging voltage according to the surface condition of the photosensitive drum 1, to prevent occurrence of image deletion until the end of the useful life of the photosensitive drum 1 by suppressing production of discharge products, and to minimize occurrence of uneven charge distribution on the photosensitive drum 1 due to a drop in the charging voltage.

Figure 9:
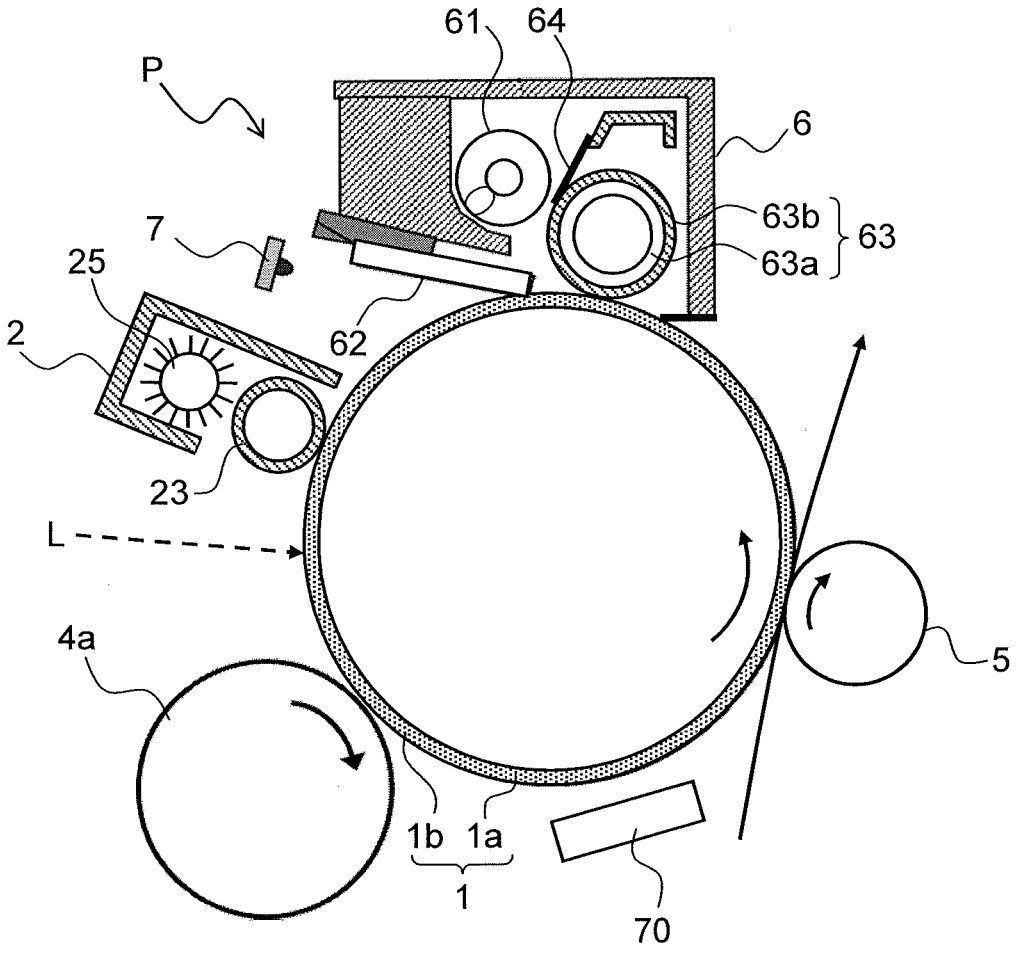
FIG. 9 is a partly enlarged view around an image forming portion in an image forming apparatus according to a second embodiment of the present disclosure.
Figure 10:
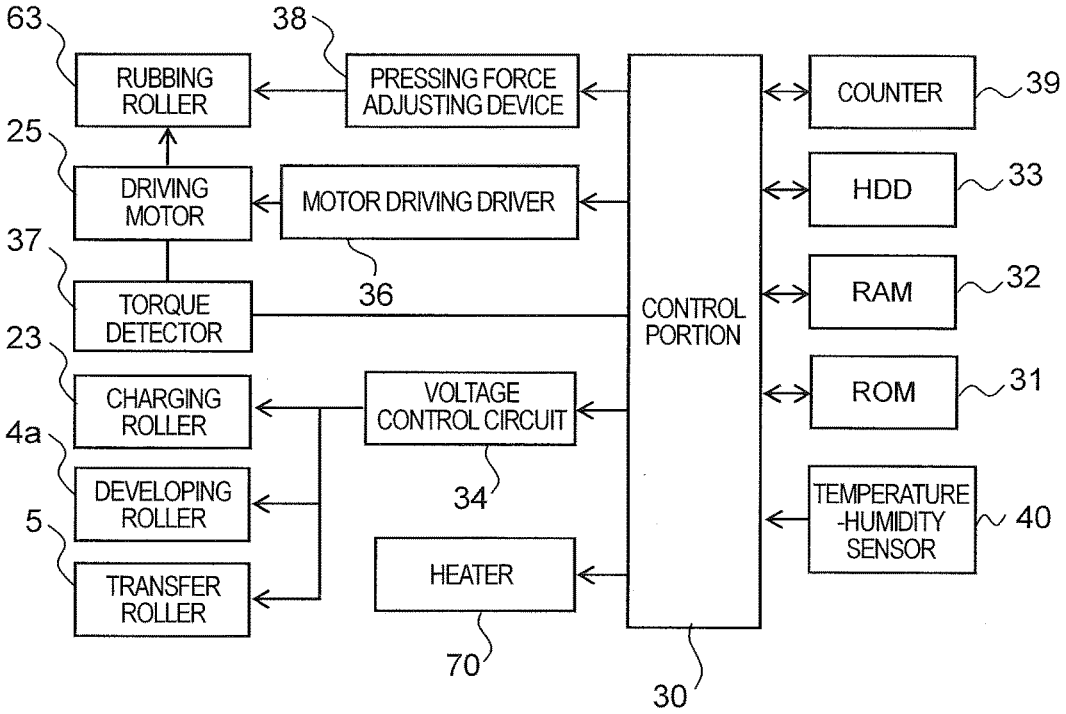
FIG. 10 is a block diagram showing an example of controlling channels in the image forming apparatus according to the second embodiment.

FIG. 9 is a partly enlarged view around an image forming portion P in an image forming apparatus 100 according to a second embodiment of the present disclosure. FIG. 10 is a block diagram showing an example of controlling channels in the image forming apparatus 100 according to the second embodiment. Such components as find their counterparts in FIGS. 2 and 3 of the first embodiment are identified by the same reference signs, and no overlapping description will be repeated.

In this embodiment, a heater 70 is provided to face the circumferential surface of the photosensitive drum 1, and by electrifying the heater 70, it is possible to heat the photosensitive drum 1. The heater 70 is turned on and off according to the rotational torque of the rubbing roller 63 detected by the torque detector 37. When the rotational torque is high, the heater 70 is turned on to heat the photosensitive drum 1 and thereby to remove moisture from the drum surface; this prevents adsorption of moisture on discharge products attached to the drum surface, and thus prevents image deletion. The heater 70 may be arranged inside the photosensitive drum 1.

For example, turning on the heater 70 in a high-temperature, high-humidity environment of 30° C. and 80% to start to heat the photosensitive drum 1 and making the relative humidity equal to or lower than 65% to enable prevention of image deletion takes about eight hours. Thus, the rotational torque of the rubbing roller 63 is detected at the completion of image formation, and according to the result of detection, whether or not to turn on the heater 70 is determined. If the rotational torque is equal to or higher than a predetermined threshold value, it is determined that removing moisture from the photosensitive drum 1 is required, and then, in a standby mode, the heater 70 is turned on to continue to heat the photosensitive drum 1. This makes it possible to prevent the adsorption of moisture on the photosensitive drum 1 in the standby mode, and thus to prevent occurrence of image deletion immediately after recovery from the standby mode.

As described above, whether or not image deletion occurs depends on the amount of discharge products attached to the surface of the photosensitive drum 1 and the degree of adsorption of moisture on the photosensitive drum 1. That is, the photosensitive drum 1 being left in a high-humidity environment for a long time is the occurrence condition. Thus, it is more effective to perform the determination based on the combination of the rotational torque of the rubbing roller 63 (the amount of discharge products attached to the surface of the photosensitive drum 1) and the humidity detected by the temperature-humidity sensor 40. For example, by detecting whether or not the installation environment of the image forming apparatus 100 is a high-humidity environment (for example, equal to or higher than the humidity of 60%) by use of the temperature-humidity sensor 40 and combining the result of detection of the humidity with the result of detection of the rotational torque of the rubbing roller 63, it is possible to turn on the heater 70 only under a condition where image deletion is more likely to occur; this helps reduce the running cost of the image forming apparatus 100 and helps achieve energy saving.

Figure 11:
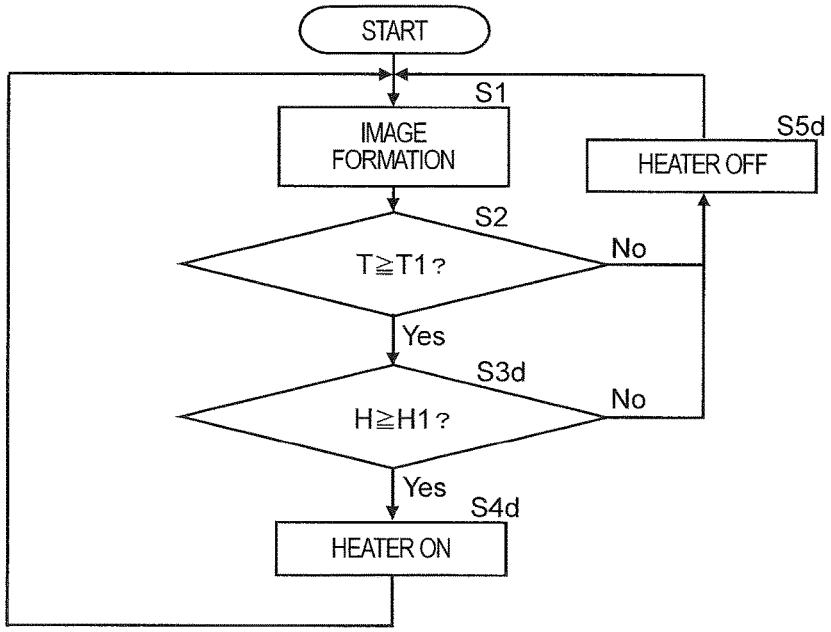
FIG. 11 is a flow chart showing an example of image degradation suppression control in the image forming apparatus according to the second embodiment.

FIG. 11 is a flow chart showing an example of image degradation suppression control in the image forming apparatus 100 according to the second embodiment. With reference to FIGS. 1, 9, and 10 as necessary, the example of image degradation suppression control according to this embodiment will be described along the steps in FIG. 11. The rotation direction and the linear velocity of the rubbing roller 63, the pressing force of the rubbing roller 63 against the photosensitive drum 1, and the predetermined value T1 of the rotational torque of the rubbing roller 63 are determined in the same manner as in the control examples of the first embodiment.

First, regular image formation is performed (Step S1). Here, the rotational torque T of the rubbing roller 63 is detected by the torque detector 37. When the image formation at Step S1 is completed, the flow proceeds to Step S2.

Next, the control portion 30 checks whether or not the rotational torque of the rubbing roller 63 detected by the torque detector 37 is equal to or higher than a predetermined value T1 (Step S2). If the rotational torque T is equal to or higher than the predetermined value T1 (Yes in Step S2), whether or not the humidity H detected by the temperature-humidity sensor 40 is equal to or higher than a predetermined value H1 is checked (Step S3*d*).

If the humidity H is equal to or higher than the predetermined value H1 (Yes in Step S3*d*), this means that a large amount of discharge products is attached to the surface of the photosensitive drum 1, and the photosensitive drum 1 is in the high-humidity environment. Thus, the heater 70 is turned on to suppress adsorption of moisture on discharge products attached to the photosensitive drum 1 (Step S4*d*).

On the other hand, if, at Step S2, the rotational torque T is lower than the predetermined value T1 (No in Step S2), or if, at Step S3*d*, the humidity H is lower than the predetermined value H1 (No in Step S3*d*), the heater 70 is left off (Step S5*d*). Then, the flow returns to Step S1, where image formation is performed again.

With the above-described control example, by measuring the rotational torque of the rubbing roller 63, as compared with a case where the driving torque of the photosensitive drum 1 is measured, the torque variation resulting from wear is reduced, and a variation in the friction resistance p of the surface of the photosensitive drum 1 can be detected more accurately. As a result, it is possible to properly turn on and off the heater 70 according to the surface condition of the photosensitive drum 1, and to prevent occurrence of image deletion up to the end of the useful life of the photosensitive drum 1.

The heater 70 is turned on only when the rotational torque T is equal to or higher than the predetermined value T1 and simultaneously the humidity H is equal to or higher than the predetermined value H1; it is thus possible to limit use of the heater 70 to only when the condition where image deletion is more likely to occur is met. This helps, while minimizing a rise in power consumption resulting from use of the heater 70, prevent occurrence of image deletion.

Figure 12:
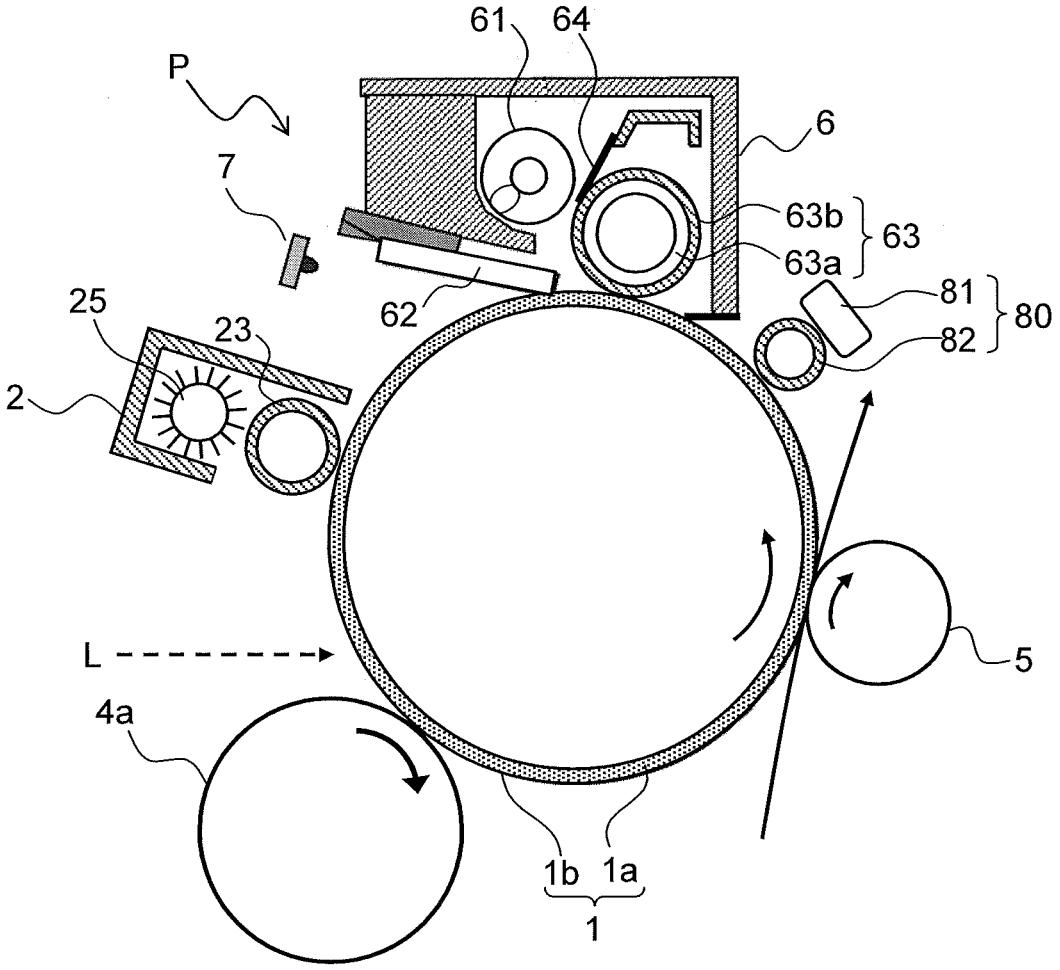
FIG. 12 is a partly enlarged view around an image forming portion of an image forming apparatus according to a third embodiment of the present disclosure.
Figure 13:
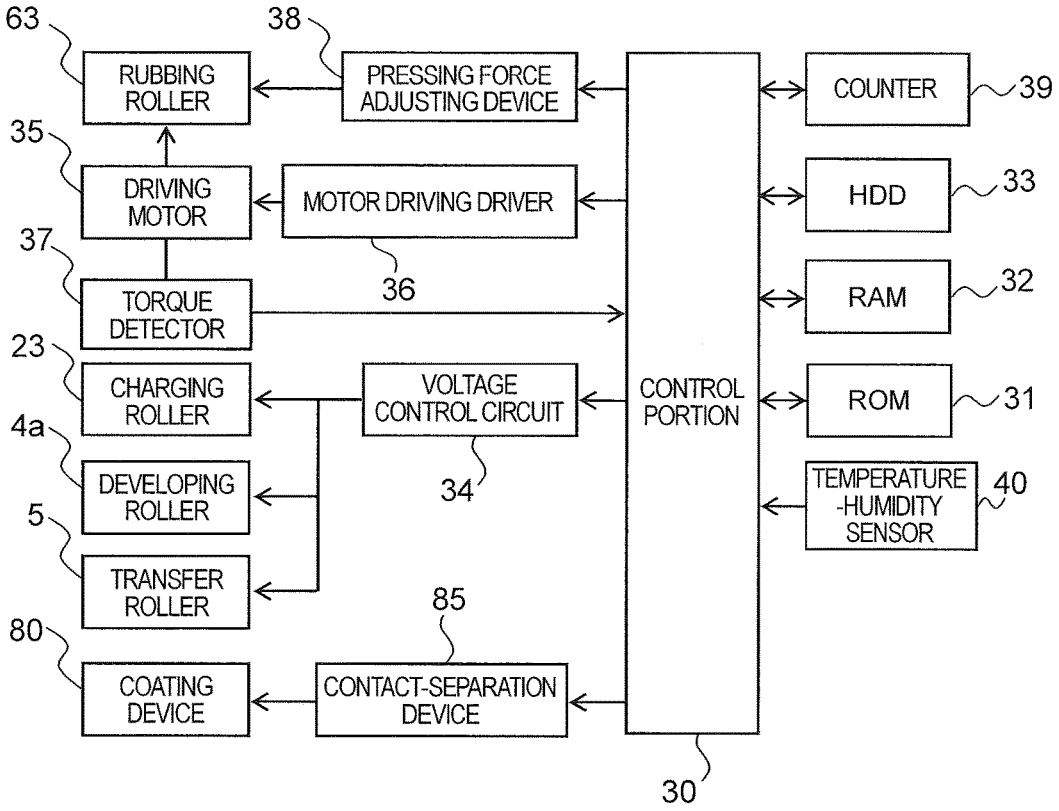
FIG. 13 is a block diagram showing an example of controlling channels in the image forming apparatus according to the third embodiment.

FIG. 12 is a partly enlarged view around an image forming portion P of an image forming apparatus 100 according to a third embodiment of the present disclosure. FIG. 13 is a block diagram showing an example of controlling channels in the image forming apparatus 100 according to the third embodiment. Such components as find their counterparts in FIGS. 2 and 3 of the first embodiment are identified by the same reference signs, and no overlapping description will be repeated.

In this embodiment, a coating device 80 is provided which applies zinc stearate to the surface of the photosensitive drum 1. Zinc stearate provides an effect of reducing the friction coefficient of the surface of the photosensitive drum 1 and suppressing adsorption of moisture on discharge products attached to the surface of the photosensitive drum 1. Thus, by applying zinc stearate to the surface of the photosensitive drum 1, it is possible to moderate the effect of image deletion resulting from adsorption of moisture on discharge products.

The coating device 80 has a zinc stearate block 81 and a coating roller 82 in contact with the zinc stearate block 81. The zinc stearate applied to the surface of the photosensitive drum 1 by the coating roller 82 is uniformly spread by the cleaning blade 62 arranged on the downstream side of the coating device 80 in the rotation direction of the photosensitive drum 1. The coating device 80 can be brought in and out of contact with the photosensitive drum 1 by a contact-separation device 85.

Figure 14:
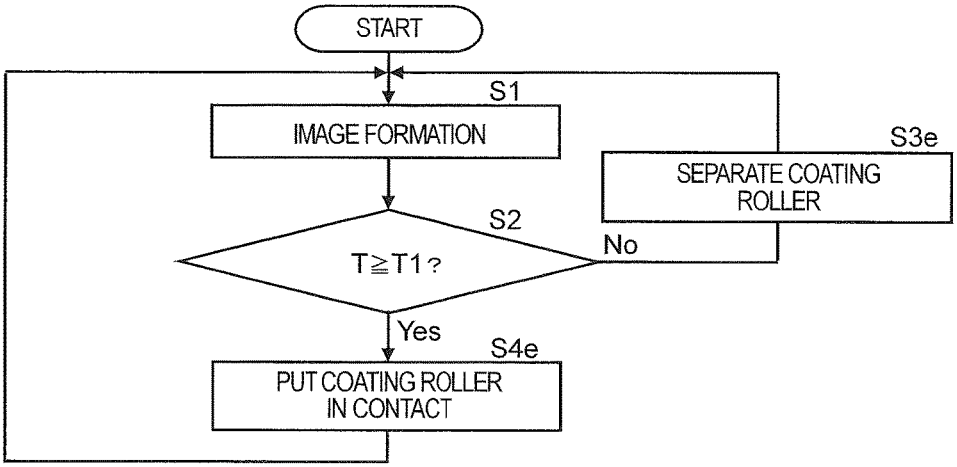
FIG. 14 is a flow chart showing an example of image degradation suppression control in the image forming apparatus according to the third embodiment.

FIG. 14 is a flow chart showing an example of image degradation suppression control in the image forming apparatus 100 according to the third embodiment. With reference to FIGS. 1, 12 and 13 as necessary, the example of image degradation suppression control will be described along the steps in FIG. 14. The rotation direction and the linear velocity of the rubbing roller 63, the pressing force of the rubbing roller 63 against the photosensitive drum 1, and the predetermined value T1 of the rotational torque of the rubbing roller 63 are determined in the same manner as in the control examples of the first embodiment. The coating device 80 is apart from the photosensitive drum 1 in a default state.

First, regular image formation is performed (Step S1). Here, the rotational torque T of the rubbing roller 63 is detected by the torque detector 37. When the image formation at Step S1 is completed, the flow proceeds to Step S2.

Next, the control portion 30 checks whether or not the rotational torque of the rubbing roller 63 detected by the torque detector 37 is equal to or higher than a predetermined value T1 (Step S2). If the rotational torque T is lower than the predetermined value T1 (No in Step S2), the coating device 80 is kept apart from the photosensitive drum 1 (Step S3*e*). Then, image formation continues to be performed until the rotational torque T becomes equal to or higher than the predetermined value T1.

If the rotational torque T is equal to or higher than the predetermined value T1 (Yes in Step S2), the flow proceeds to Step S3*e*. The rotational torque T being equal to or higher than the predetermined value T1 means that the friction coefficient μ of the surface of the photosensitive drum 1 is high. That is, as described above, the hardness of the surface protection layer 22 is high (the fluorine content is low), and thus the coating device 80 is brought into contact with the surface of the photosensitive drum 1 (Step S4*e*) to apply zinc stearate to the surface of the photosensitive drum 1. Then, the flow returns to Step S1, and thereafter the contact-separation control of the coating device 80 is repeated in the same manner.

By performing the contact-separation control of the coating device 80 with respect to the photosensitive drum 1 according to the rotational torque of the rubbing roller 63 detected by the torque detector 37 as described above, it is possible to prevent image deletion by suppressing adsorption of moisture on discharge products attached to the surface of the photosensitive drum 1, and to prevent wear and tear of the zinc stearate block 81 resulting from unnecessary application of zinc stearate.

Figure 15:
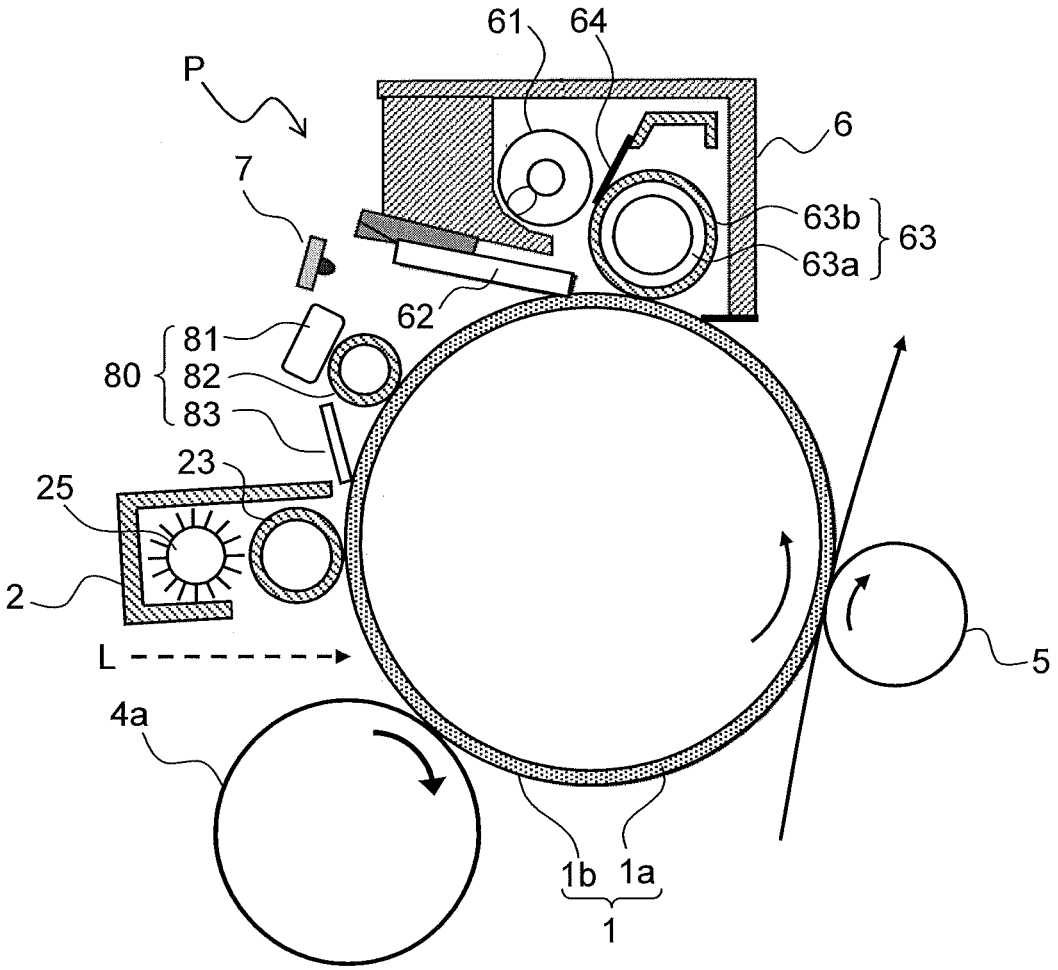
FIG. 15 is a partly enlarged view showing another configuration example around the image forming portion in the image forming apparatus according to the third embodiment.

Although the above-described embodiment deals with a configuration where the coating device 80 is arranged on the upstream side of the cleaning device 6 in the rotation direction of the photosensitive drum 1 to apply zinc stearate with the coating roller 82, and the zinc stearate is spread by use of the cleaning blade 62; instead, as shown in FIG. 15, the coating device 80 may be arranged on the downstream side of the cleaning device 6 in the rotation direction of the photosensitive drum 1. In the configuration in FIG. 15, the coating device 80 is provided with a smoothing member 83 in addition to the zinc stearate block 81 and the coating roller 82, and the zinc stearate is spread by use of the smoothing member 83 arranged on the downstream side of the coating roller 82.

Although, in the above-described embodiment, adsorption of moisture on discharge products is suppressed by application of zinc stearate, this is not meant as any limitation to zinc stearate; instead, such solid hydrophobic lubricants as to have no adverse effect on image formation may be applied. Examples of solid hydrophobic lubricants include metal salts of higher fatty acids other than zinc stearate, colloidal silicas, and natural waxes. Examples of metal salts of higher fatty acids include barium stearate, lead stearate, iron stearate, nickel stearate, cobalt stearate, copper stearate, strontium stearate, calcium stearate, cadmium stearate, magnesium stearate, zinc oleate, lead oleate, iron oleate, cobalt oleate, copper oleate, magnesium oleate, zinc palmitate, cobalt palmitate, copper palmitate, calcium palmitate, aluminum palmitate, magnesium palmitate, lead caprylate, lead caproate, zinc linolenate, cobalt linolenate, and calcium linolenate. Examples of natural waxes include carnauba wax.

As described above, in the image forming apparatus 100 according to this embodiment, the surface condition of the photosensitive drum 1 (the photosensitive layer 1*b*) is checked based on the rotational torque T of the rubbing roller 63 in contact with the photosensitive drum 1. Then, if the rotational torque T is equal to or higher than the predetermined value T1, it is determined that discharge products are attached to the surface of the photosensitive drum 1, and the image degradation suppression process is executed. This helps prevent occurrence of image deletion throughout the useful life of the photosensitive drum 1, helps minimize the frequency of executing the image degradation suppression process, and helps maintain image quality by minimizing a drop in the success rate of forming images. It is also possible to reduce the running cost of the image forming apparatus 100.

The embodiments described above are in no way meant to limit the present disclosure, which thus allows for many modifications and variations within the spirit of the present disclosure. For example, needless to say, the scope of the present disclosure encompasses any structure obtained by combining together different features from the above-described embodiments.

Although, in the above-described embodiments, the predetermined value T1 of the rotational torque of the rubbing roller 63 is not limited to one that is previously set and stored in the HDD 33; it may instead be, for example, one that is calculated and stored in the HDD 33 after the start of use. The memory in which the predetermined value T1 is stored is not limited to the HDD 33. When the predetermined value T1 is previously set before shipment, it may be stored in the ROM 31. In this case, the ROM 31 serves as a memory.

The present disclosure is applicable to image forming apparatuses provided with a photosensitive member on which a photosensitive layer and a surface protection layer are formed. Based on the present disclosure, it is possible to provide an image forming apparatus that can accurately detect the degree of a rise in the friction resistance of the surface of a photosensitive member by use of the torque variation of a polishing member in contact with the photosensitive member, with no additional detecting means, and that can properly execute an image degradation suppression process by use of the result of detection.

What is claimed is:

1. An image forming apparatus comprising:

a photosensitive member having a photosensitive layer and a surface protection layer which is formed on a surface of the photosensitive layer and which has a hardness higher than a hardness of the photosensitive layer;

a charging member which electrostatically charges the photosensitive member;

an exposing device which forms an electrostatic latent image on a surface of the photosensitive member having been electrostatically charged by the charging member;

a developing device having a toner carrying member which carries thereon toner containing polishing particles, the developing device feeding toner from the toner carrying member to the photosensitive member and thereby developing the electrostatic latent image into a toner image;

a transfer member which transfers the toner image formed on the photosensitive member to a recording medium;

a polishing member having an elastic layer on a circumferential surface thereof in contact with the photosensitive member, the polishing member polishing the surface of the photosensitive member while rotating in contact with the photosensitive member with a linear velocity difference from a linear velocity of the photosensitive member;

a driving device which drives the polishing member to rotate;

a voltage applying device which applies voltages to the charging member, the toner carrying member, and the transfer member respectively;

a torque detector which detects a torque of the driving device observed when the polishing member is driven to rotate; and a control portion which estimates an attachment condition of discharge products to the surface of the photosensitive member based on the torque of the driving device detected by the torque detector, wherein when the torque of the driving device detected by the torque detector is equal to or higher than a predetermined value, the control portion performs an image degradation suppression process to prevent degradation of image quality resulting from the discharge products.

2. The image forming apparatus of claim 1, wherein if the torque of the driving device detected by the torque detector is equal to or higher than the predetermined value, the control portion increases at least one of the linear velocity difference of the polishing member from the linear velocity of the photosensitive member and a pressing force of the polishing member against the photosensitive member.

3. The image forming apparatus of claim 1, wherein if the torque of the driving device detected by the torque detector is equal to or higher than the predetermined value, the control portion increases a developing voltage applied to the toner carrying member during image formation.

4. The image forming apparatus of claim 1, wherein if the torque of the driving device detected by the torque detector is equal to or higher than the predetermined value, the control portion reduces a transfer voltage applied to the transfer member during image formation.

5. The image forming apparatus of claim 1, wherein the voltage applying device applies a charging voltage having a DC voltage and an AC voltage superimposed on each other to the charging member, and if the torque of the driving device detected by the torque detector is equal to or higher than the predetermined value, the control portion reduces a peak-to-peak value of the AC voltage applied to the charging member during image formation.

6. The image forming apparatus of claim 1, further comprising:

a heater which heats the photosensitive member, wherein if the torque of the driving device detected by the torque detector is equal to or higher than the predetermined value, the control portion turns on the heater to electrify the heater.

7. The image forming apparatus of claim 6, further comprising:

a humidity detector which detects a humidity around the photosensitive member, wherein if the torque of the driving device detected by the torque detector is equal to or higher than the predetermined value and simultaneously the humidity detected by the humidity detector is equal to or higher than a predetermined value, the control portion turns on the heater to electrify the heater.

8. The image forming apparatus of claim 1, further comprising:

a coating device which applies a solid hydrophobic lubricant to the surface of the photosensitive member, wherein if the torque of the driving device detected by the torque detector is equal to or higher than the predetermined value, the control portion increases an amount of the solid hydrophobic lubricant applied by the coating device.

9. The image forming apparatus of claim 8, further comprising:

a contact-separation device which brings the coating device in and out of contact with the photosensitive member, wherein if the torque of the driving device detected by the torque detector is equal to or higher than the predetermined value, the control portion brings the coating device into contact with the photosensitive member.

10. The image forming apparatus of claim 8, wherein the coating device has a block of the solid hydrophobic lubricant, and a coating roller which makes contact with the block of the solid hydrophobic lubricant and the photosensitive member, and if the torque of the driving device detected by the torque detector is equal to or higher than the predetermined value, the control portion increases the rotation speed of the coating roller.

11. The image forming apparatus of claim 8, wherein the solid hydrophobic lubricant is zinc stearate.

12. The image forming apparatus of claim 1, wherein when no image is being formed, a photosensitive member polishing mode is executable in which toner is discharged from the developing device to the surface of the photosensitive member, and the surface of the photosensitive member is polished by use of the polishing member, and if the torque of the driving device detected by the torque detector is equal to or higher than the predetermined value, the control portion executes the photosensitive member polishing mode.

13. The image forming apparatus of claim 12, wherein if the torque of the driving device detected by the torque detector after the photosensitive member polishing mode has been executed is equal to or higher than the predetermined value, the control portion lengthens duration of subsequent execution of the photosensitive member polishing mode.

14. The image forming apparatus of claim 12, wherein if the torque of the driving device detected by the torque detector after the photosensitive member polishing mode has been executed is equal to or higher than the predetermined value, the control portion increases an amount of toner discharged from the developing device to the photosensitive member during subsequent execution of the photosensitive member polishing mode.

15. The image forming apparatus of claim 12, wherein if the torque of the driving device detected by the torque detector after the photosensitive member polishing mode has been executed is equal to or higher than the predetermined value, the control portion rotates the polishing member in a direction opposite to a rotation direction of the photosensitive member at a position at which the polishing member and the photosensitive member face each other during subsequent execution of the photosensitive member polishing mode.

16. The image forming apparatus of claim 1, wherein in the photosensitive member, the photosensitive layer is an amorphous silicon photosensitive layer, and the surface protection layer comprises amorphous carbon containing fluorine or amorphous silicon carbide containing fluorine.

17. The image forming apparatus of claim 1, wherein in the photosensitive member, the photosensitive layer is an organic photosensitive layer, and the surface protection layer comprises a charge transport cured film containing a charge transport material.

18. The image forming apparatus of claim 1, wherein the torque detector detects a rotational torque of the polishing member by detecting an output current value of the driving device.

* * * * *